US010624818B2

(12) United States Patent
Hausman

(10) Patent No.: US 10,624,818 B2
(45) **Date of Patent: *Apr. 21, 2020**

(54) BABY BOTTLE HOLDING DEVICES, SYSTEMS AND METHODS

(71) Applicant: Harley Hausman, Earp, CA (US)

(72) Inventor: Harley Hausman, Earp, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/440,750

(22) Filed: Jun. 13, 2019

(65) Prior Publication Data

US 2019/0290547 A1 Sep. 26, 2019

Related U.S. Application Data

(63) Continuation-in-part of application No. 15/682,253, filed on Aug. 21, 2017, now abandoned, which is a continuation of application No. 15/184,093, filed on Jun. 16, 2016, now Pat. No. 9,737,464, which is a continuation of application No. 14/678,391, filed on Apr. 3, 2015, now Pat. No. 9,370,468, which is a continuation of application No. 14/465,093, filed on Aug. 21, 2014, now Pat. No. 8,998,029.

(51) Int. Cl.
*A61J 9/06* (2006.01)
*A61J 11/00* (2006.01)

(52) U.S. Cl.
CPC ..... *A61J 9/0669* (2015.05); *A61J 9/0623* (2015.05); *A61J 11/00* (2013.01)

(58) Field of Classification Search
CPC ..... A61J 9/06; A61J 9/0669; A61J 9/0623; A61J 11/00
USPC ..... 220/737
See application file for complete search history.

(56) References Cited

U.S. PATENT DOCUMENTS

| | | | |
|---|---|---|---|
| 1,474,593 | A | 11/1923 | Jennings |
| 2,122,628 | A | 7/1938 | Tracy |
| 3,058,708 | A | 10/1962 | Murray et al. |
| 3,073,493 | A | 1/1963 | Pfaffenberger |
| 3,718,360 | A | 2/1973 | Knutzen |

(Continued)

FOREIGN PATENT DOCUMENTS

JP 09285525 A 11/1997

OTHER PUBLICATIONS

International Search Report and Written Opinion received in co-pending International Patent Application No. PCT/US2015/045954, dated Dec. 14, 2015 in 13 pages.

(Continued)

*Primary Examiner* — King M Chu
(74) *Attorney, Agent, or Firm* — Knobbe Martens Olson & Bear, LLP

(57) ABSTRACT

A support system for a baby bottle includes a support body. The support body includes a first rim at a first end defining a first opening, a second rim at a second end defining a second opening, a channel extending between the first opening and the second opening, a slot extending between the first end and the second end, a neck portion configured to be positioned about a bottle neck of a baby bottle, and a generally convex or generally concave portion extending between the neck portion and the second end. The support system also includes a pair of handle portions coupled to the support body. Each handle portion includes a handle grip portion and a handle attachment portion.

20 Claims, 27 Drawing Sheets

(56) References Cited

U.S. PATENT DOCUMENTS

| | | | | |
|---|---|---|---|---|
| 3,773,287 | A | 11/1973 | Hechinger | |
| 3,945,524 | A | 3/1976 | Tkaciukas | |
| 3,990,596 | A | 11/1976 | Hottman | |
| 4,014,505 | A | 3/1977 | Dowd | |
| D277,700 | S | 2/1985 | Heber | |
| 4,497,417 | A | 2/1985 | Tabet | |
| 4,723,801 | A | 2/1988 | Musumeci et al. | |
| D298,717 | S | 11/1988 | Nichols | |
| D303,150 | S | 8/1989 | Falcon | |
| 4,941,579 | A | 7/1990 | Lee | |
| 4,943,017 | A | 7/1990 | Ennis | |
| 5,060,816 | A | 10/1991 | Robbins, III | |
| 5,174,965 | A | 12/1992 | Jones et al. | |
| D356,161 | S | 3/1995 | Peterson | |
| 5,573,141 | A | 11/1996 | Chen | |
| 5,655,805 | A | 8/1997 | Shaddy | |
| 5,765,715 | A | 6/1998 | Hughes | |
| 5,772,069 | A * | 6/1998 | Price | A47G 23/0216 220/737 |
| 5,800,319 | A | 9/1998 | Choate | |
| 5,816,631 | A | 10/1998 | Kochan | |
| 6,037,872 | A | 3/2000 | Dunnum | |
| 6,315,153 | B1 | 11/2001 | Oxborn | |
| 7,726,499 | B2 | 6/2010 | Williamson | |
| 7,954,773 | B2 | 6/2011 | Carnevali | |
| 8,123,069 | B1 | 2/2012 | Mumaw et al. | |
| 8,152,012 | B1 | 4/2012 | Berglund | |
| 8,998,029 | B1 | 4/2015 | Hausman | |
| 9,370,468 | B2 | 6/2016 | Hausman | |
| 9,737,464 | B2 | 8/2017 | Hausman | |
| 2005/0211855 | A1 | 9/2005 | Rayman | |
| 2011/0204017 | A1 | 8/2011 | O'Sullivan | |

OTHER PUBLICATIONS

International Preliminary Report on Parentability received in co-pending International Application No. PCT/US2015/045954, dated Feb. 21, 2017 in 8 pages.

* cited by examiner

BABY BOTTLE HOLDING DEVICES, SYSTEMS AND METHODS

TECHNICAL FIELD

The present application relates to systems, devices, and methods for holding baby bottles. In particular, the present application relates to systems, devices, and methods for facilitating the holding of baby bottles by babies.

DESCRIPTION OF THE RELATED TECHNOLOGY

Baby bottles can be difficult for a baby to hold. Bottles are often too large for a baby's hands to grip. Bottles can also be slippery. Babies can lack sufficient coordination to hold a bottle in an appropriate position while also feeding on the contents of the bottle.

Some bottle systems have a cap with two handles connected to the cap that extend directly opposite each other on opposite sides of the cap, and extend down along the sides of the bottle when the cap is positioned on the bottle. Some bottle systems have a ring that is positioned between a top of the bottle and a cap. The ring includes two handles directly opposite each other on opposite sides of the ring that extend along the sides of the bottle when the ring and cap are positioned on the bottle. These systems can be unsatisfactory for some babies to hold. For example, handles on directly opposite sides of the bottle are spaced apart too wide for some babies to hold. Additionally, handles on directly opposite sides of the bottle may be difficult for the baby to hold at an appropriate orientation to deliver the contents of the bottle to the baby for feeding. Additionally, these systems can be unsatisfactory because the handle components are limited to use with a specific bottle system. Additionally, in some of these systems a ring positioned between the cap and bottle can lead to leakage between the cap and bottle.

There exists a need for systems, devices, and methods for holding baby bottles to facilitate holding by babies, provide for improved delivery of the contents of the bottle to the baby, provide systems that are interchangeable with other bottle systems, and limit leakage.

SUMMARY

The systems, methods and devices described herein have innovative aspects, no single one of which is indispensable or solely responsible for their desirable attributes. Without limiting the scope of the claims, some of the advantageous features will now be summarized.

One aspect of the present disclosure is the realization that traditional baby bottle systems lack handle systems that facilitate holding by babies, provide for improved delivery of the contents of the bottle to the baby, provide systems that are interchangeable with other bottle and cup systems, and limit leakage. Thus, there exists a need for a modular handle system which does not suffer from the deficiencies of conventional handle systems.

One non-limiting embodiment of the present disclosure includes a baby bottle holding system. The system comprises a baby bottle. The system comprises a support body having a generally cylindrical portion. A channel is defined within the support body. A slot is defined between slot edges of the support body extending between a first end portion and a second end portion. First and second handle portions are coupled to the support body. The first and second handle portions are coupled to the support body at an angle less than about 120 degrees apart from each other about a surface of the support body. The support body is sized and configured to support the baby bottle when positioned within the channel defined within the support body. In some embodiments, the first and second handle portions have handle grip portions that are coupled to the support body at an angle between about 5 degrees and about 30 degrees relative to a surface of the support body.

In another embodiment, a support system for a baby bottle comprises a support body having a generally cylindrical portion. A channel is defined within the support body. A slot is defined between slot edges of the support body extending between a first end portion and a second end portion. First and second handle portions are coupled to the support body. The first and second handle portions are coupled to the support body at an angle less than about 120 degrees apart from each other about a surface of the support body. The support body is sized and configured to support a baby bottle positioned within the channel defined within the support body. In some embodiments, the first and second handle portions have handle grip portions that are coupled to the support body at an angle between about 5 degrees and about 30 degrees relative to a surface of the support body.

In another embodiment, a support system for a baby bottle comprises a support body having a generally cylindrical portion. The support system comprises a neck portion. A first opening is defined by a first rim of the neck portion at a first end portion. A second opening is defined by a second rim of the support body at a second end portion. A channel is defined within the support body extending between the first opening and the second opening. A slot is defined between slot edges of the support body extending between the first end portion and the second end portion. First and second handle portions are coupled to the support body. The first and second handle portions have handle grip portions and handle attachment portions. The first and second handle portions are coupled to the support body at an angle less than 180 degrees apart from each other about a surface of the support body. The support body is sized and configured to receive, releasably grip, and support a baby bottle positioned within the channel defined within the support body. In some embodiments, the first and second handle portions are coupled to the support body at different angles apart from each other about a surface of the support body. In some embodiments, the first and second handle portions are coupled to the support body at different angles relative to the slot. In some embodiments, the first and second handle portions are coupled to the support body at different angles relative to a surface of the support body. In some embodiments, the first opening generally defines a first opening cross-sectional area, the second opening generally defines a second opening cross-sectional area, and the second opening cross-sectional area is greater than the first opening cross-sectional area.

In another embodiment, a support system for a baby bottle comprises a support body extending between a first end and a second end. The support body comprising a first rim at the first end, the first rim defining a first opening, and a second rim at a second end, the second rim defining a second opening. The support body further comprises a channel extending between the first opening and the second opening. The channel is configured to receive at least a portion of a baby bottle. The support body further comprises a slot extending between the first end and the second end, a neck portion configured to be positioned about a bottle neck of the baby bottle, and a generally convex portion extending between the neck portion and the second end. The generally convex portion comprises a middle portion having a first cross-sectional area, a superior portion positioned between the middle portion and the first end, the superior portion having a second cross-sectional area, and an inferior portion positioned between the middle portion and the second end, the inferior portion defining a third cross-sectional area, wherein the first cross-sectional area is greater than the second cross-sectional area and the third cross-sectional area. The support system also comprises a pair of handle portions coupled to the support body, each handle portion comprising a handle grip portion and a handle attachment portion.

In some embodiments, a cross-sectional area of the generally convex portion narrows from the middle portion to the neck portion. In some embodiments, a cross-sectional area of the generally convex portion narrows from the middle portion to the second end. In some embodiments, a cross-sectional area of the neck portion narrows from the generally convex portion to the first end. In some embodiments, a cross-sectional area of the second opening is greater than a cross-sectional area of the first opening. In some embodiments, the support system further comprises the baby bottle positioned within the channel. In some embodiments, the support body is configured to releasably grip and support the baby bottle positioned within the channel. In some embodiments, the slot is defined by slot edges in the support body extending from the first rim to the second rim. In some embodiments, the pair of handles are coupled to the support body at an angle less than 180 degrees apart from each other about a surface of the support body. In some embodiments, each handle of the pair of handles is coupled to the support body at an angle less than 180 degrees apart from the slot about a surface of the support body.

In some embodiments, a support system for a baby bottle comprises a support body extending between a first end and a second end. The support body comprises a first rim at the first end, the first rim defining a first opening, and a second rim at a second end, the second rim defining a second opening. The support body also comprises a channel extending between the first opening and the second opening. The channel is configured to receive at least a portion of a baby bottle. The support body further comprises a slot extending between the first end and the second end, a neck portion configured to be positioned about a bottle neck of the baby bottle, and a generally concave portion extending between the neck portion and the second end. The generally concave portion comprises a middle portion having a first cross-sectional area, a superior portion positioned between the middle portion and the first end, the superior portion having a second cross-sectional area, and an inferior portion positioned between the middle portion and the second end, the inferior portion defining a third cross-sectional area, wherein the first cross-sectional area is smaller than the second cross-sectional area and the third cross-sectional area. The support system also comprises a pair of handle portions coupled to the support body, each handle portion comprising a handle grip portion and a handle attachment portion.

In some embodiments, a cross-sectional area of the generally concave portion widens from the middle portion to the neck portion. In some embodiments, a cross-sectional area of the generally concave portion widens from the middle portion to the second end. In some embodiments, a cross-sectional area of the neck portion narrows from the generally concave portion to the first end. In some embodiments, a cross-sectional area of the second opening is greater than a cross-sectional area of the first opening. In some embodiments, the slot is defined by slot edges in the support body extending from the first rim to the second rim. In some embodiments, the support system further comprising the baby bottle positioned within the channel. In some embodiments, the support body is configured to releasably grip and support the baby bottle positioned within the channel. In some embodiments, the pair of handles are coupled to the support body at an angle less than 180 degrees apart from each other about a surface of the support body. In some embodiments, each handle of the pair of handles is coupled to the support body at an angle less than 180 degrees apart from the slot about a surface of the support body.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting Like reference numbers and designations in the various drawings indicate like elements.

DETAILED DESCRIPTION

Figure 1:
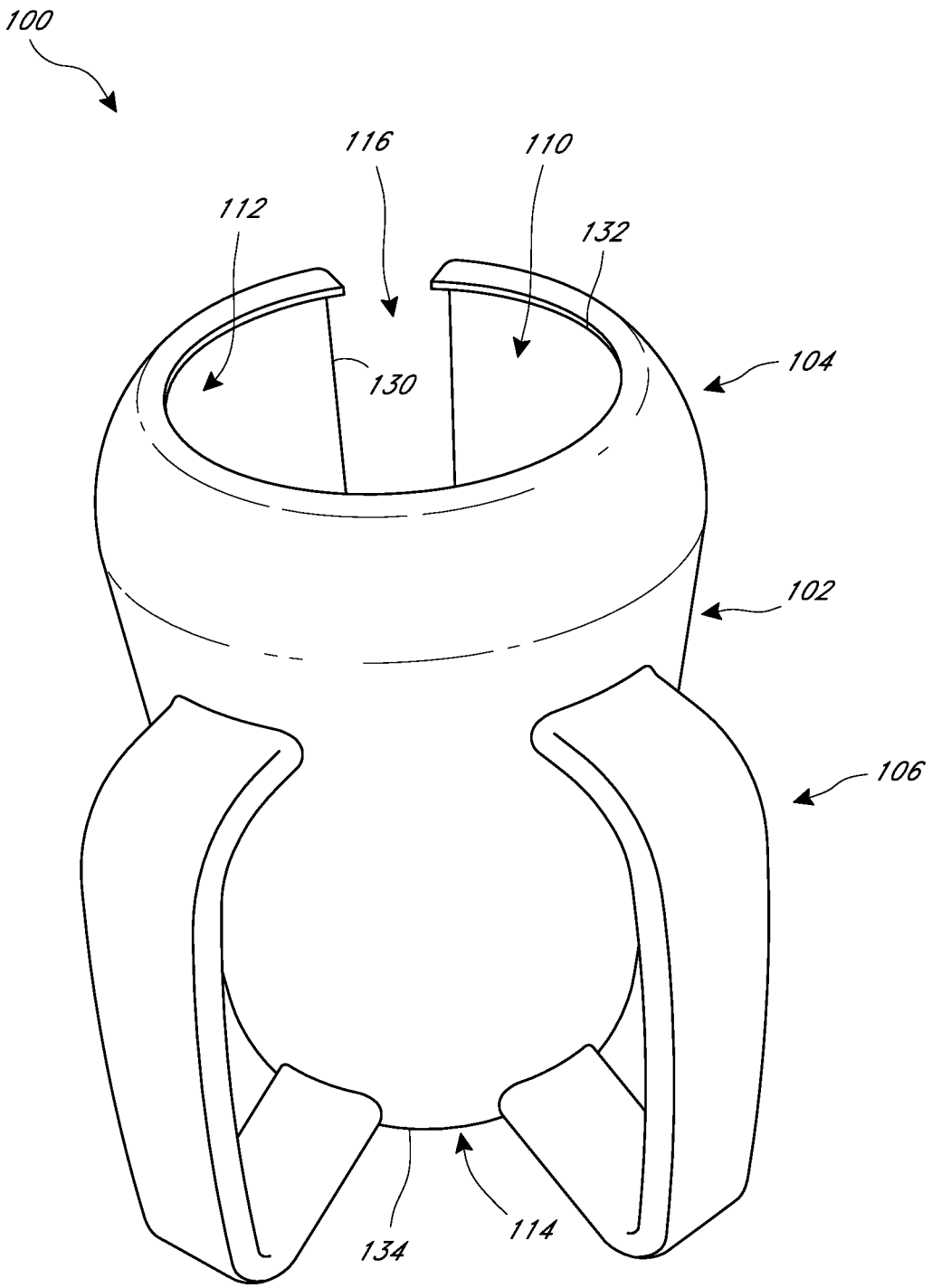
FIG. 1 illustrates a perspective view of one embodiment of a bottle support system.
Figure 1A:
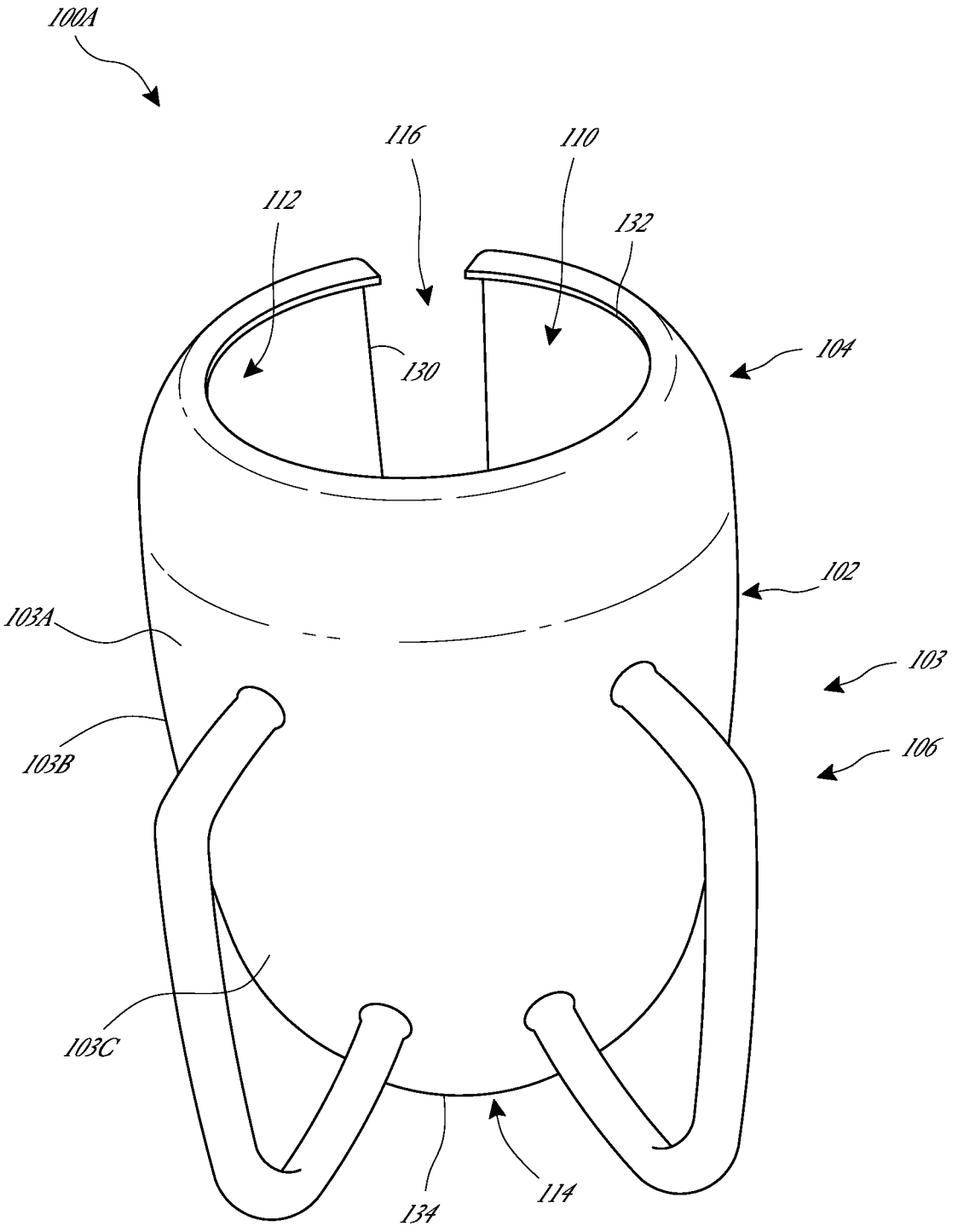
FIG. 1A illustrates a perspective view of one embodiment of a bottle support system.
Figure 1B:
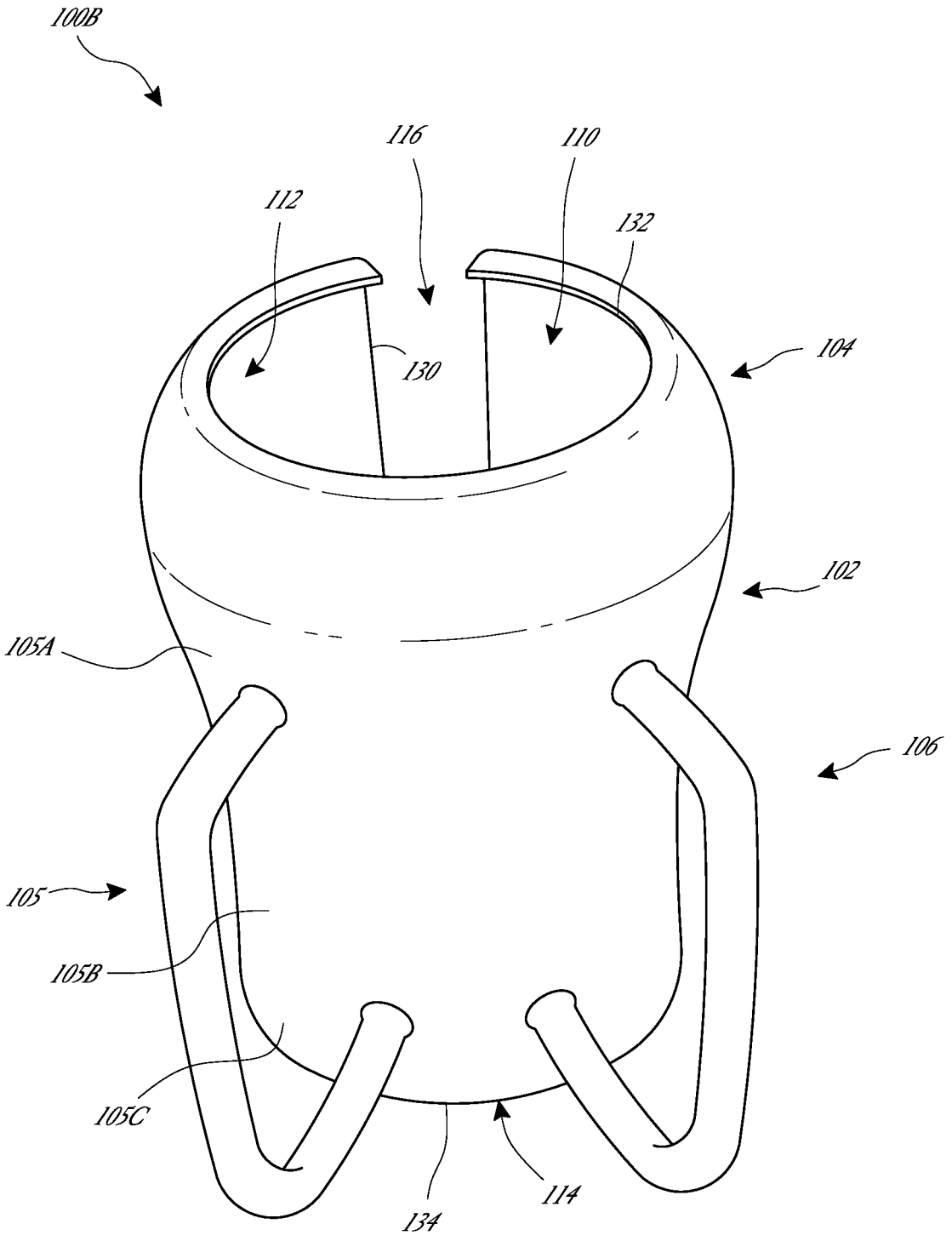
FIG. 1B illustrates a perspective view of one embodiment of a bottle support system.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the relevant art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

Embodiments described herein generally relate to systems, devices, and methods for holding baby bottles. More specifically, some embodiments relate to systems, devices, and methods for facilitating the holding of baby bottles by babies. For example, in some embodiments, a support system for a baby bottle comprises a support body and first and second handle portions coupled to the support body. The support body preferably comprises a channel defined within the support body, and a slot defined in the support body and extending between a first end portion and a second end portion. The first and second handle portions are preferably coupled to the support body at an angle less than about 120 degrees apart from each other about a surface of the support body. The support body is preferably sized and configured to support a baby bottle positioned within the channel defined within the support body. In some embodiments, the first and second handle portions have handle grip portions that are coupled to the support body at an angle between about 5 degrees and about 30 degrees relative to a surface of the support body. Other configurations are also possible, including those described herein.

FIG. 1 illustrates a perspective view of one embodiment of a baby bottle support system 100. In some embodiments, a baby bottle support system 100 can include a support body 102 having a generally cylindrical portion. The support body 102 preferably has an upper curved section forming a neck portion 104. First and second handle portions 106 are coupled to the support body 102.

A channel 110 is defined within the support body 102 extending between a first opening 112 and a second opening 114. The first opening 112 is generally defined by a first rim 132 of the neck portion 104 at a first end portion as shown in the upper portion of FIG. 1. The second opening 114 is generally defined by a second rim 134 of the support body 102 at a second end portion as shown in the lower portion of FIG. 1. A slot 116 is generally defined between slot edges 130 of the support body 102 extending between the first end portion and the second end portion.

Figure 2:
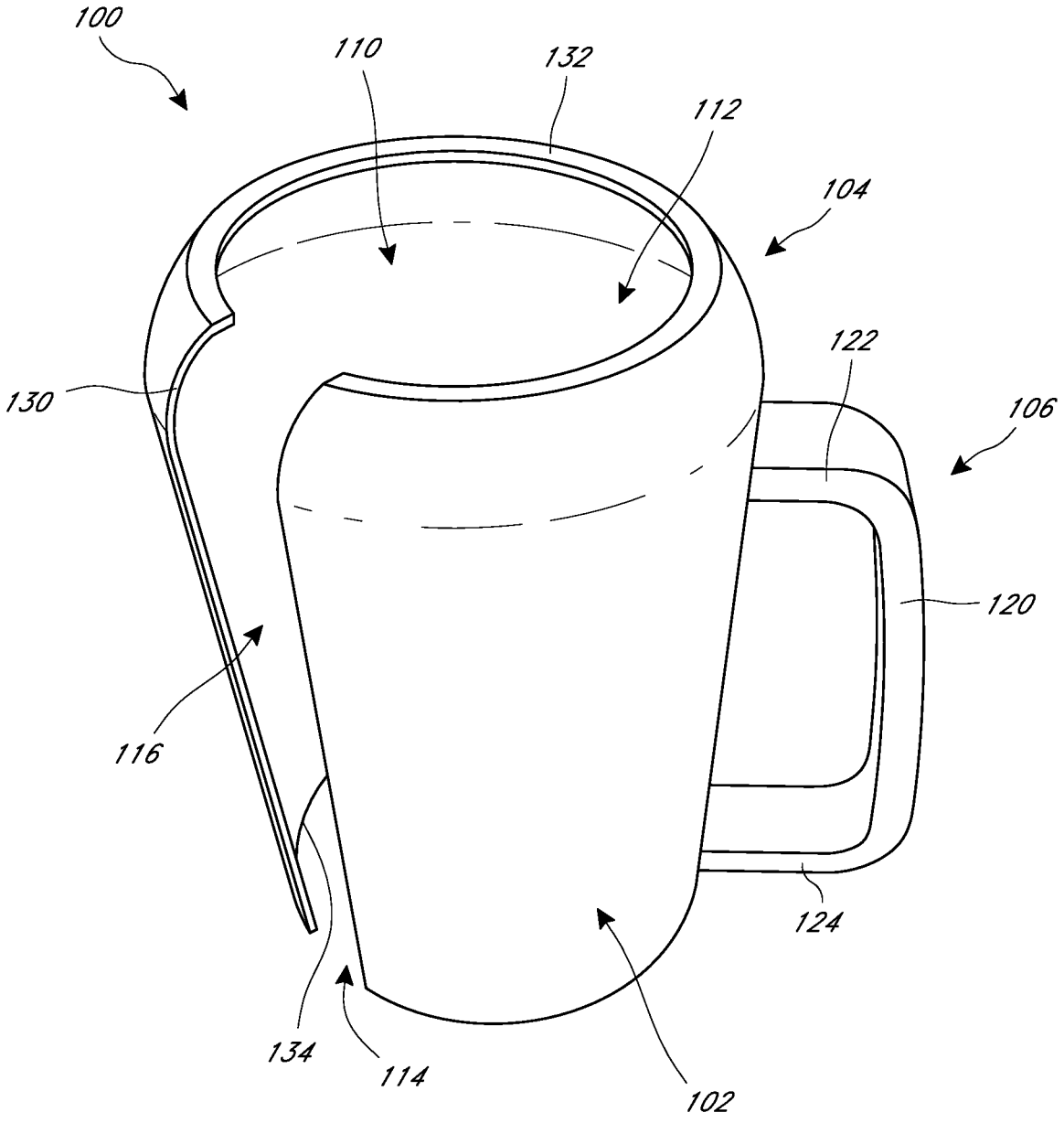
FIG. 2 illustrates a perspective view of the bottle support system of FIG. 1.
Figure 2A:
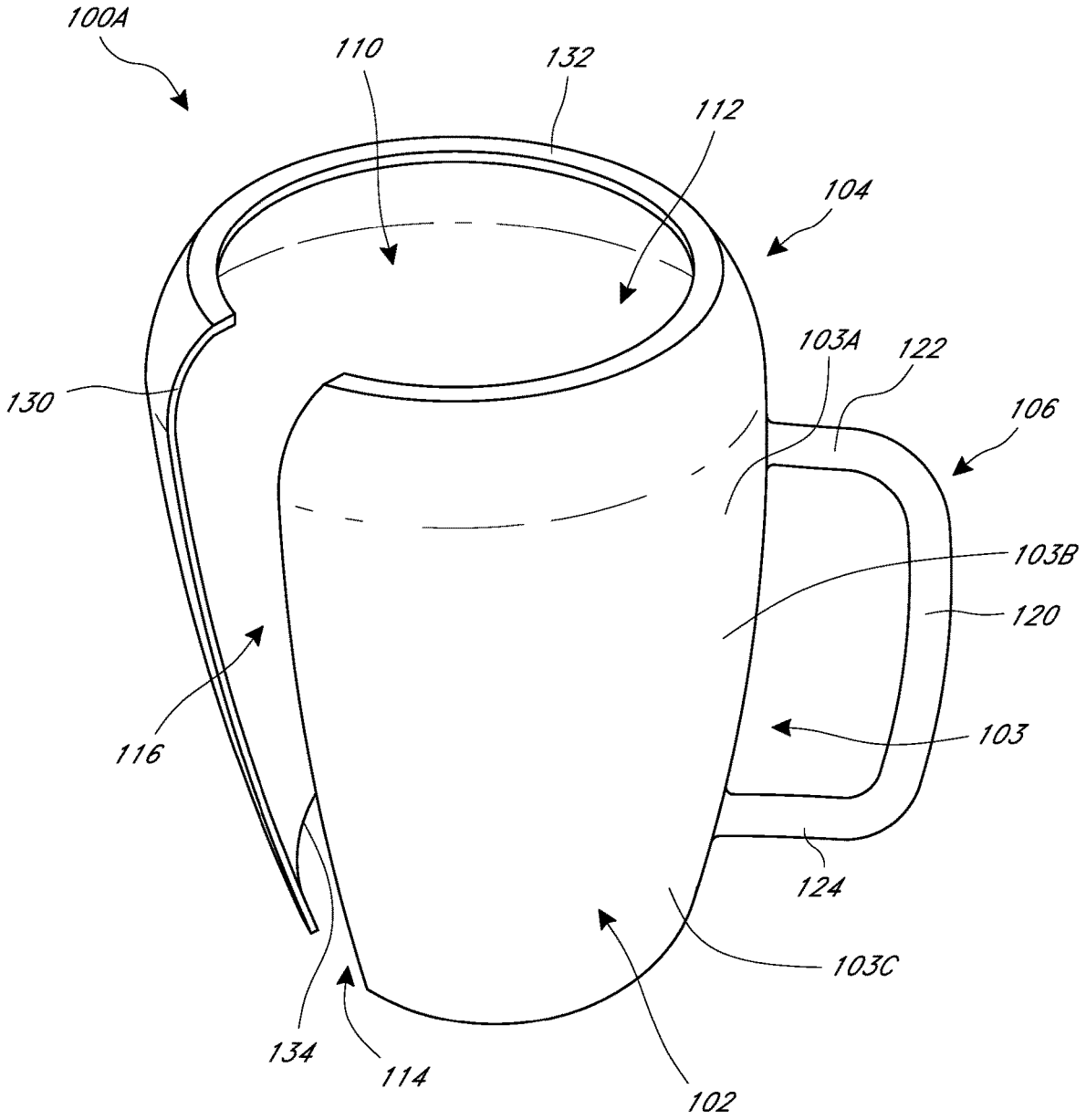
FIG. 2A illustrates a perspective view of the bottle support system of FIG. 1A.
Figure 2B:
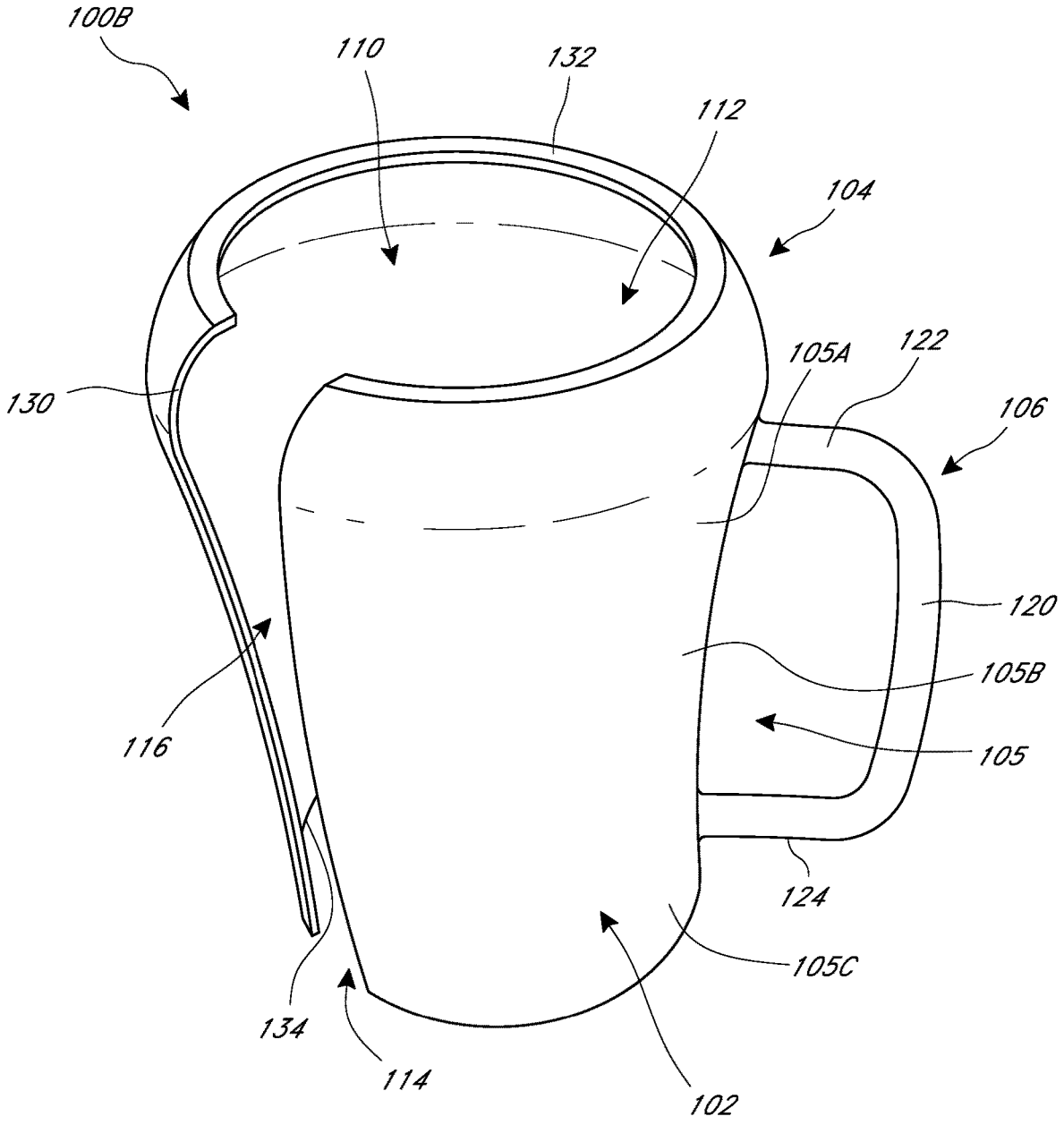
FIG. 2B illustrates a perspective view of the bottle support system of FIG. 1B.
Figure 3:
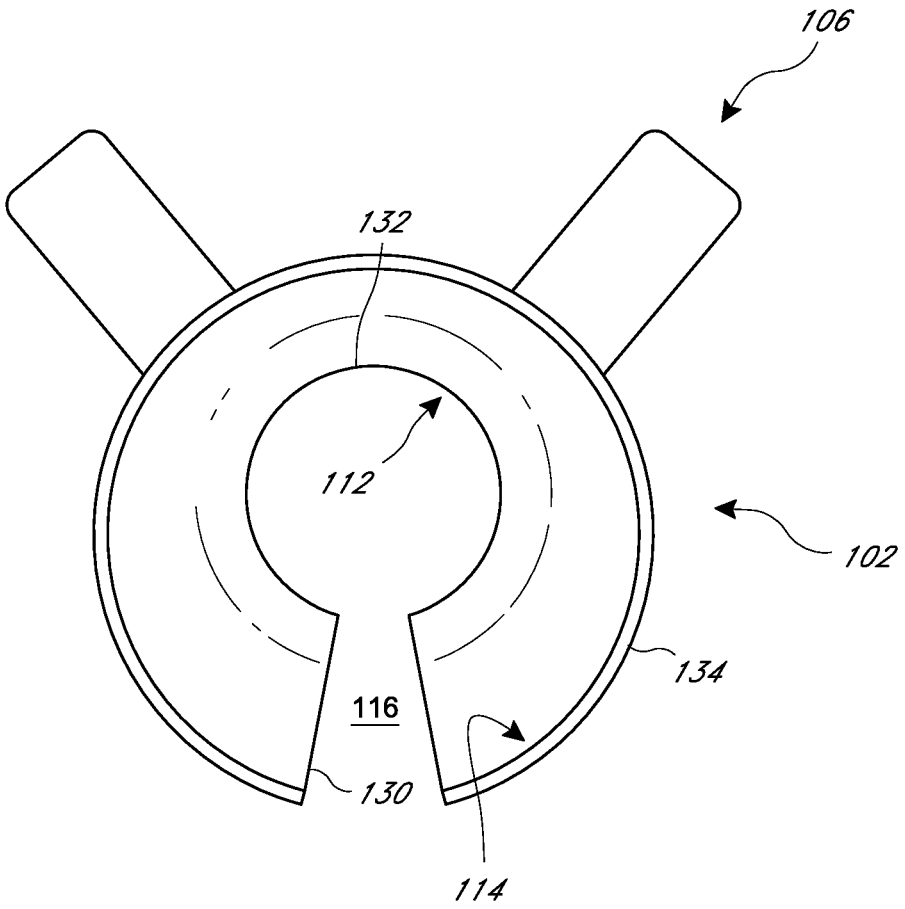
FIG. 3 illustrates a bottom perspective view of the bottle support system of FIG. 1.
Figure 3A:
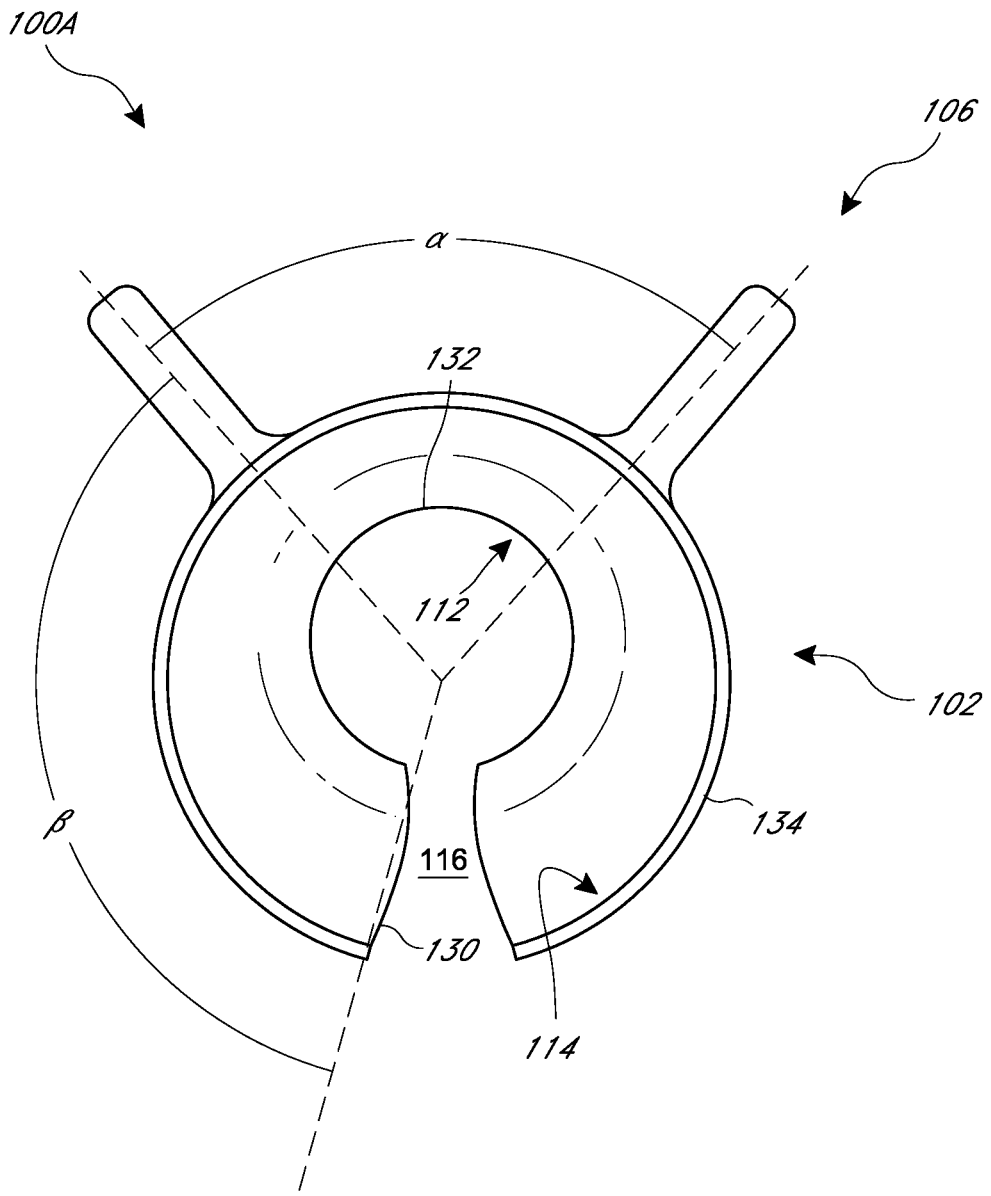
FIG. 3A illustrates a bottom perspective view of the bottle support system of FIG. 1A.
Figure 3B:
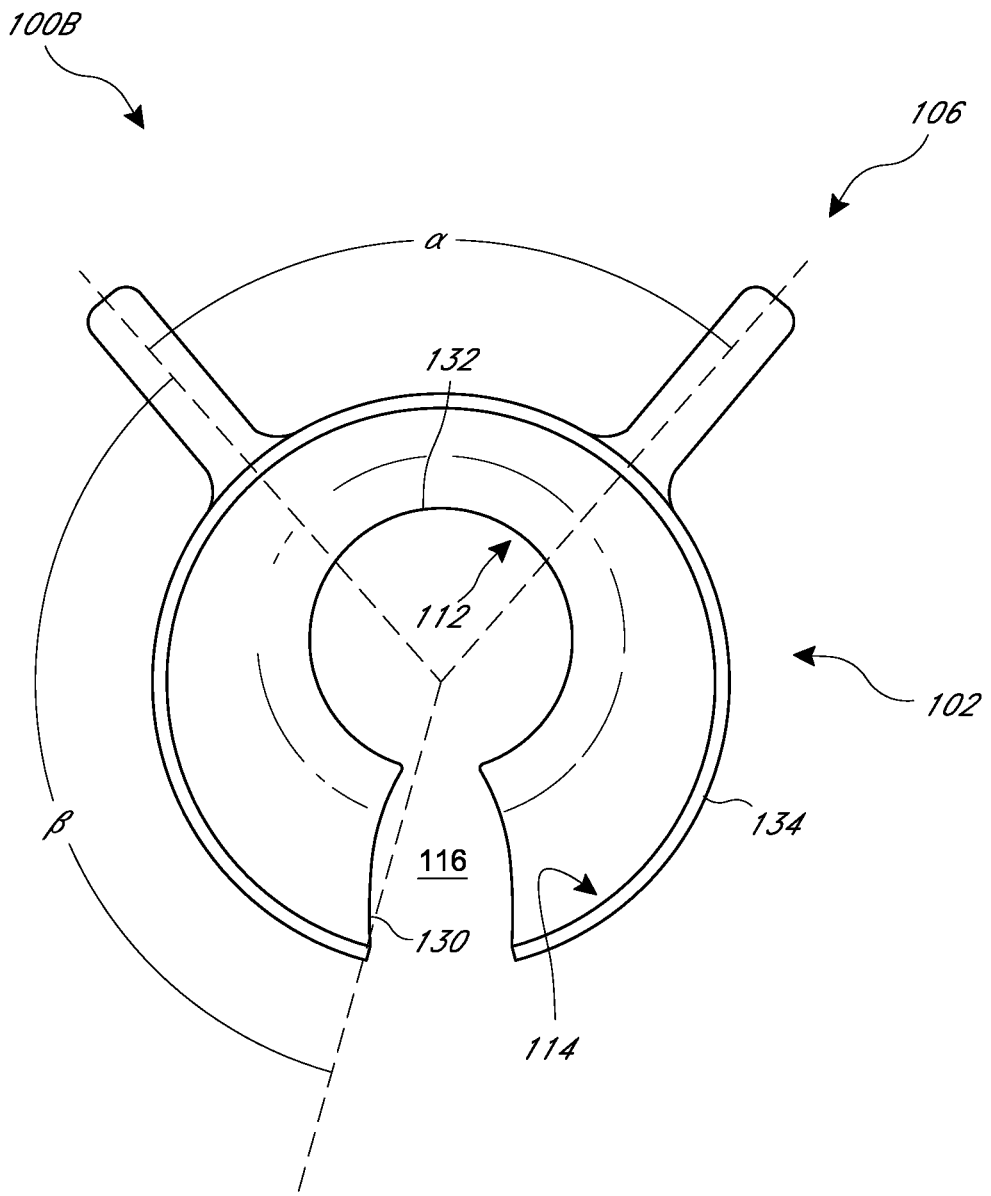
FIG. 3B illustrates a bottom perspective view of the bottle support system of FIG. 1B.

With reference to FIGS. 2 and 3, the first and second handle portions 106 have handle grip portions 120 and handle attachment portions 122, 124. The first and second handle portions 106 are preferably coupled to the support body 102 at an angle less than 180 degrees apart from each other about a surface of the support body 102. In some embodiments, the first and second handle portions are coupled to the support body at an angle less than 150 degrees apart from each other about a surface of the support body. In some embodiments, the first and second handle portions are coupled to the support body at an angle less than 120 degrees apart from each other about a surface of the support body. In some embodiments, the first and second handle portions are coupled to the support body at an angle less than 90 degrees apart from each other about a surface of the support body. In some embodiments, the first and second handle portions are coupled to the support body at an angle less than 60 degrees apart from each other about a surface of the support body.

In some embodiments, the first and second handle portions 106 are coupled to the support body between about 120 degrees and about 60 degrees apart from each other about a surface of the support body. In some embodiments, the first and second handle portions are coupled to the support body between about 90 degrees and about 60 degrees apart from each other about a surface of the support body.

In some embodiments, the first and second handle portions 106 are coupled to the support body at an angle less than 180 degrees apart from the slot about a surface of the support body. In some embodiments, the first and second handle portions are coupled to the support body at an angle less than 150 degrees apart from the slot about a surface of the support body. In some embodiments, the first and second handle portions 106 are coupled to the support body at an angle less than 120 degrees apart from the slot about a surface of the support body.

In some embodiments, the first and second handle portions are coupled to the support body between about 150 degrees and about 90 degrees apart from the slot about a surface of the support body. In some embodiments, the first and second handle portions are coupled to the support body between about 150 degrees and about 120 degrees apart from the slot about a surface of the support body.

In some embodiments, the handle grip portions 120 are coupled to the support body 102 at an angle relative to a surface of the support body. In some embodiments, the handle grip portions are coupled to the support body at an angle between about 5 degrees and about 30 degrees relative to a surface of the support body. In some embodiments, the handle grip portions are coupled to the support body at an angle between about 10 degrees and about 20 degrees relative to a surface of the support body. In some embodiments, the handle grip portions are coupled to the support body at an angle of about 15 degrees relative to a surface of the support body. In some embodiments, the handle grip portions are coupled to the support body generally parallel to a surface of the support body.

In some embodiments, the first opening 112 generally defines a first opening cross-sectional area, and the second opening 114 generally defines a second opening cross-sectional area, where the second opening cross-sectional area is greater than the first opening cross-sectional area.

Figure 4:
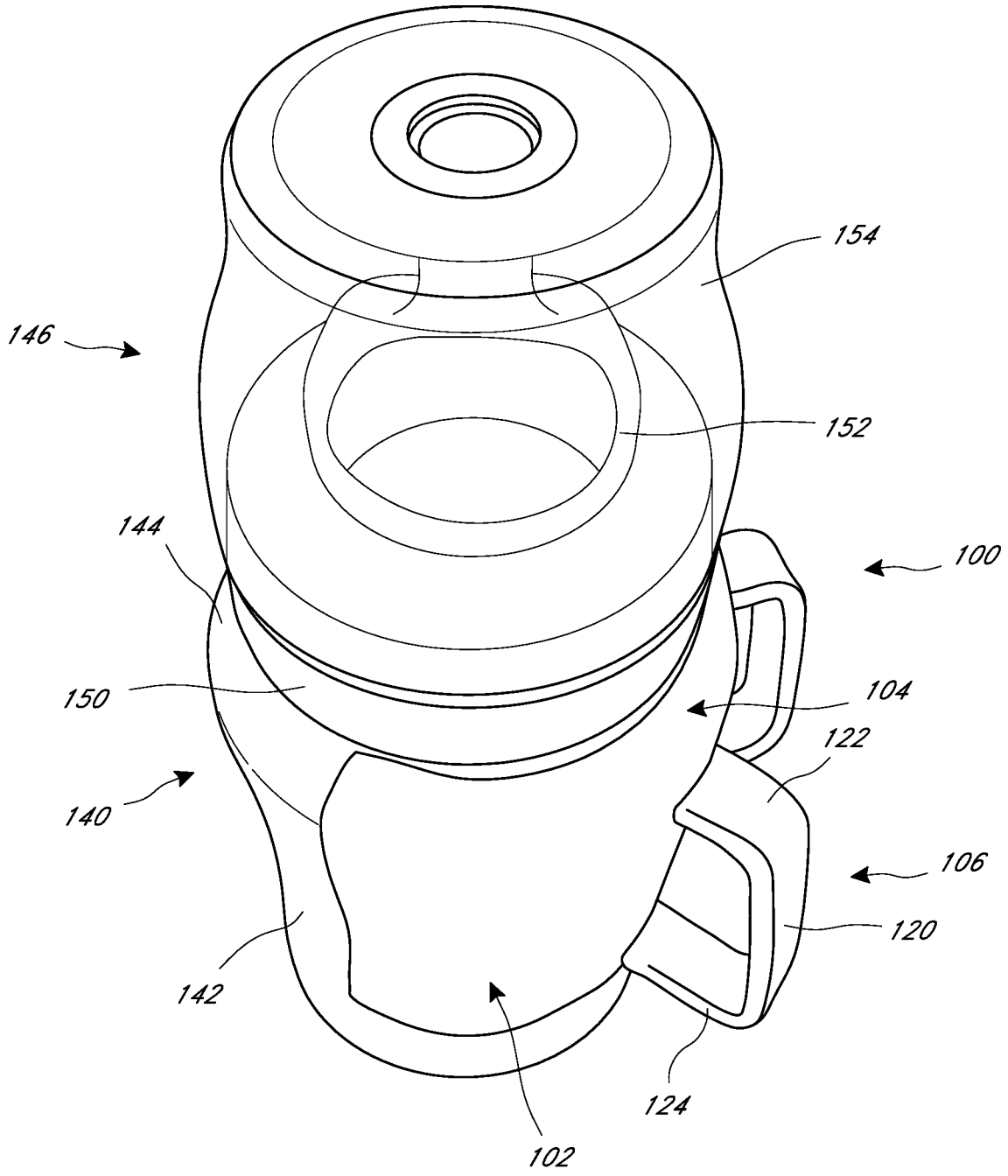
FIG. 4 illustrates a perspective view of the bottle support system of FIG. 1 coupled to a bottle system.
Figure 4A:
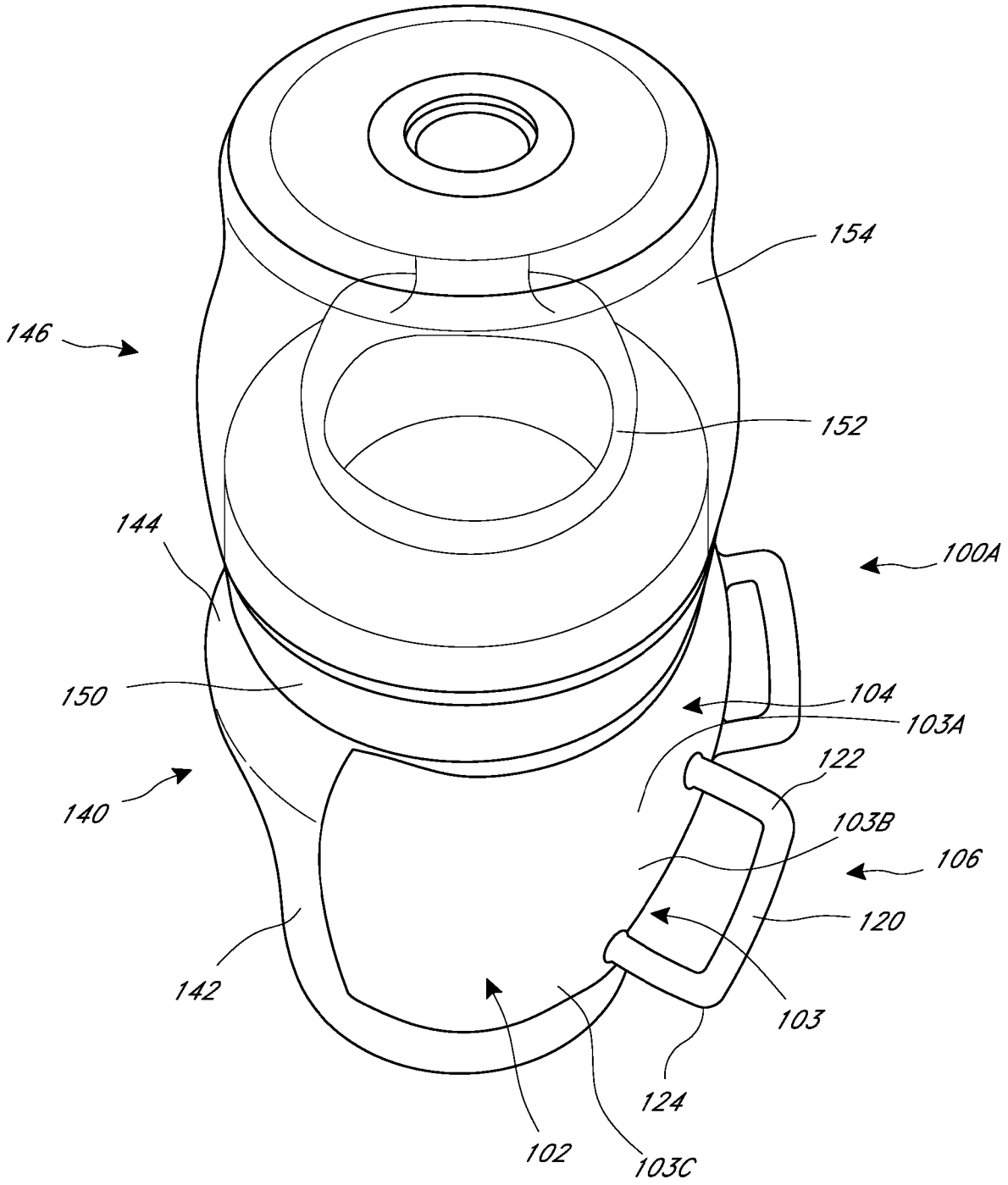
FIG. 4A illustrates a perspective view of the bottle support system of FIG. 1A coupled to a bottle system.
Figure 4B:
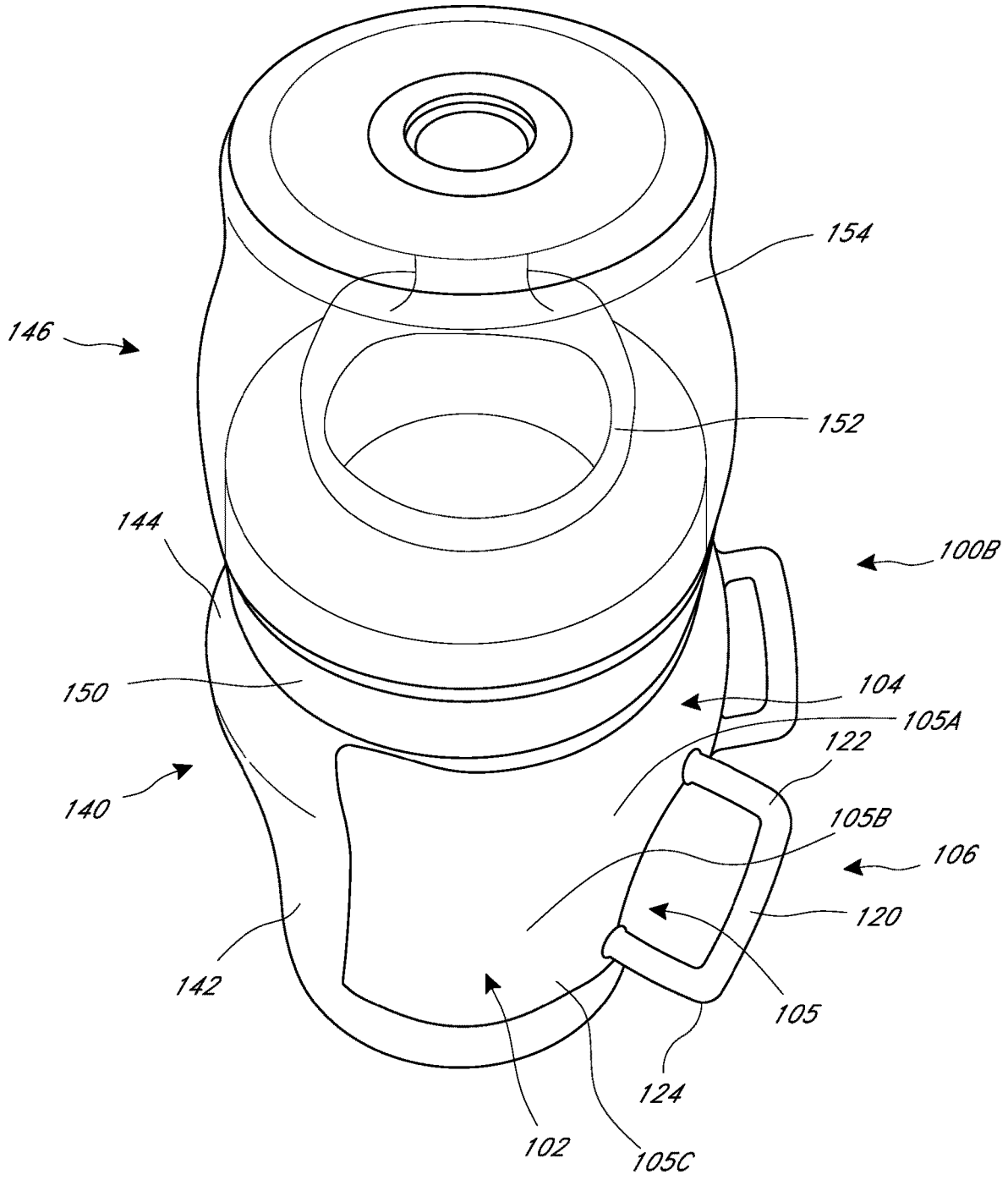
FIG. 4B illustrates a perspective view of the bottle support system of FIG. 1B coupled to a bottle system.

With reference to FIG. 4, the support body 102 is preferably sized and configured to receive, releasably grip, and support a baby bottle positioned within the channel 110 defined within the support body 102. For example, a baby bottle system 140 can include a bottle body 142, a bottle neck 144, and a cap system 146. In some embodiments, the cap system 146 can include a cap attachment 150, a nipple portion 152, and a cover 154. In some embodiments, the bottle system can comprise a baby bottle, a sippy cup, or another suitable liquid container.

The support body can comprise a flexible material, a semi-rigid material, and/or a rigid material. In some embodiments, the support body is formed of a plastic material. The handle portions of the support system can comprise a flexible material, a semi-rigid material, and/or a rigid material. In some embodiments, the handle portions are formed of a plastic material. In some embodiments, the handle portions are formed integrally with the support body. In some embodiments, the handle portions are formed monolithically with the support body. In some embodiments, the handle portions can be removably coupled to the support body. In some embodiments a single handle with multiple gripping portions can be provided. The multiple gripping portions can be configured to be positioned about the support body generally in angled locations as described herein with respect to multiple handle arrangements and/or relative to the slot position.

The slot defined in the support body and the material of the support body, are preferably configured to allow for the slot to expand and contract. For example, in some embodiments, to position a baby bottle system within the channel defined in the support body, portions of the support body can be flexed to cause expansion of the slot to a sufficient amount such that the bottle body can be inserted into the channel of the support body through the expanded slot along an axis normal to a longitudinal axis of the channel. Once the bottle system is positioned within the channel, the support body preferably contracts around the bottle system such that support body substantially forms a compression fit with the baby bottle. In a preferred configuration, a neck portion of the support body is preferably positioned about a neck portion of the bottle system. In some embodiments, the neck portion of the support body provides the advantage of supporting the bottle system at the neck portion to limit sliding or movement between the support body and the bottle system. The support body preferably holds and supports the bottle system. In some embodiments, to remove the bottle system from the support body, the bottle system is pulled toward the slot while the support body is held in position. Portions of the support body preferably flex to expand the slot and allow for the bottle system to be removed from the body support.

In some embodiments, the bottle body can be positioned within the channel along a longitudinal axis of the channel by advancing the bottle system along the longitudinal axis. In some embodiments the bottle system can be coupled to the support system using other mechanical components, including, for example, one or more of a latch, a clip, a clamp, or another suitable component to allow a support system to releasably couple to a bottle system.

In use, with the support system coupled to the bottle system, a baby or other user can hold the handles of the support system to support the bottle system. In some embodiments, the position, configuration and orientation of the handles facilitate gripping by the user. In some embodiments, the position, configuration and orientation of the handles facilitate positioning the bottle in an appropriate orientation to deliver contents of the bottle to the user. For example, in some embodiments the handles are angled relative to a surface of the support body such that when the handle gripping portions are held in a generally horizontal position by a user in a generally reclined position and/or in a generally horizontal resting position, the bottle system is preferably oriented with the nipple portion downward toward the user to facilitate delivery of the contents of the bottle to the user.

The support system can be provided on its own, or with a bottle system. In some embodiments the support system can be configured to function with a variety of bottle systems of varying shapes and sizes. The flexibility of the support system preferably allows for variations in bottle systems. The bottle support system has the advantage of providing a handle support system that is independent of a bottle or liquid container, allowing for the support system to be conveniently coupled and/or uncoupled from the bottle.

In some other embodiments, advantageous handle configurations described herein can be coupled directly to a bottle and/or bottle system itself rather than to a support system. In some other embodiments, the support system does not include a curved neck portion.

Figure 5:
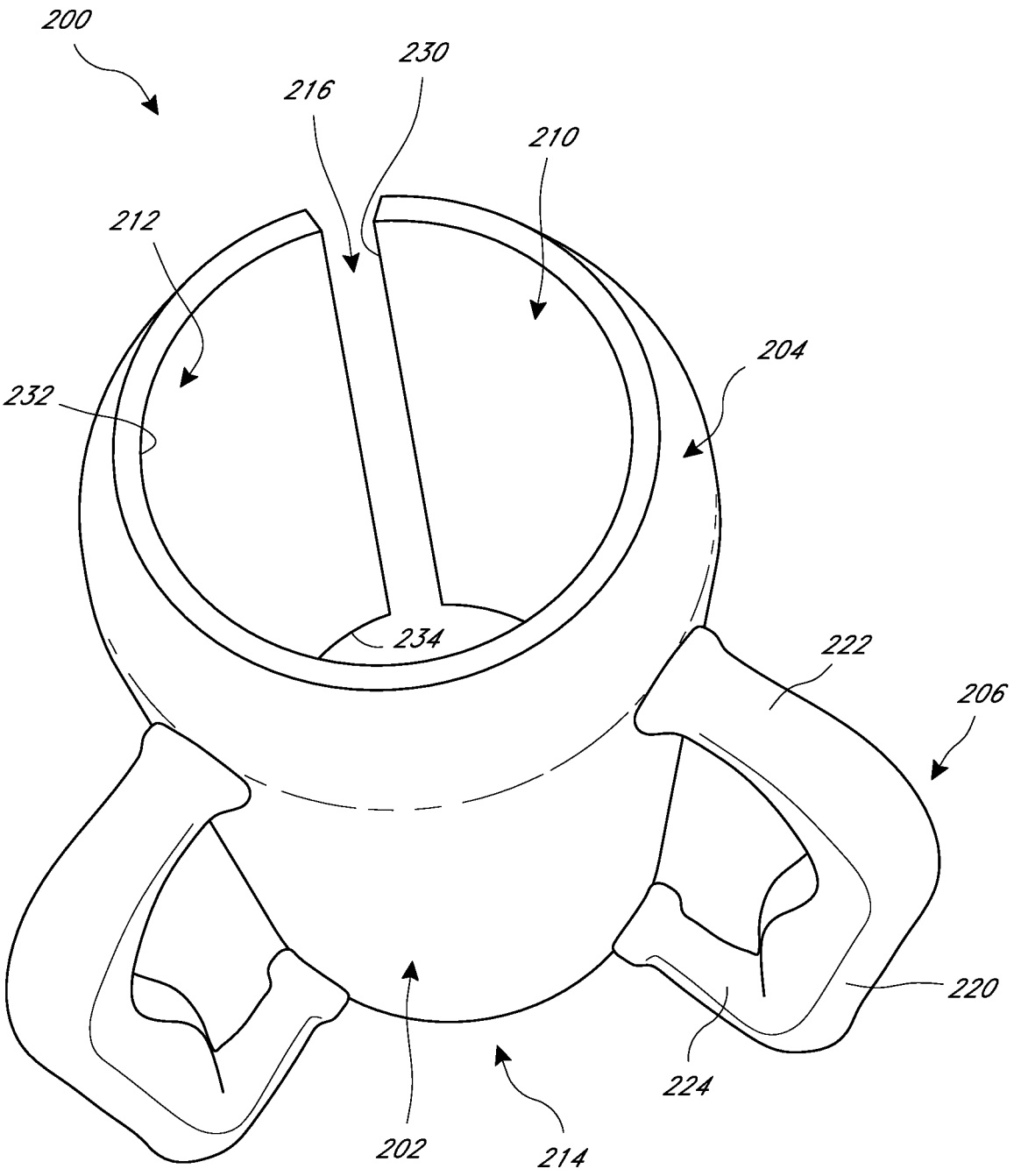
FIG. 5 illustrates a perspective view of another embodiment of a bottle support system.
Figure 5A:
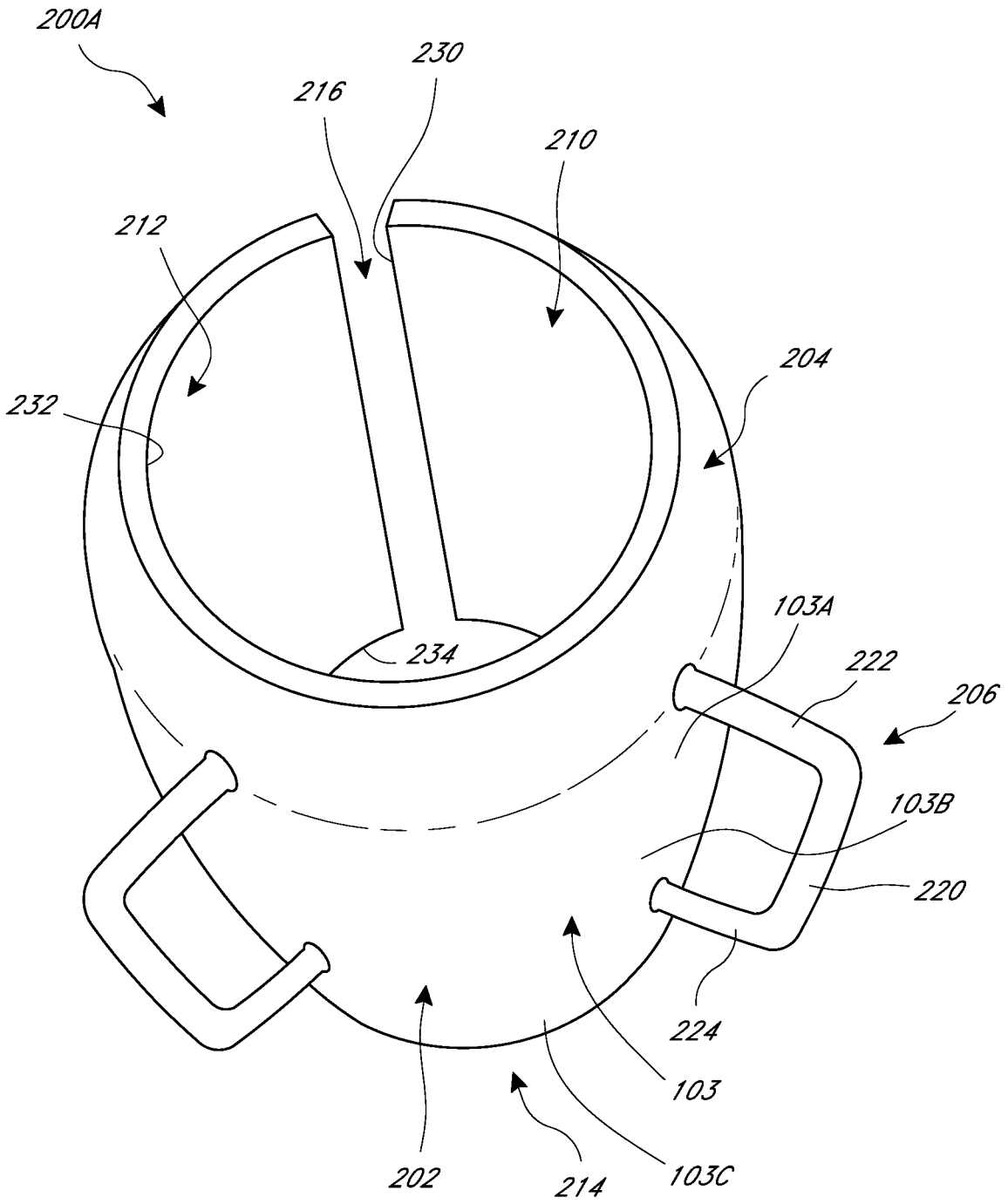
FIG. 5A illustrates a perspective view of the bottle another embodiment of a bottle support system.
Figure 5B:
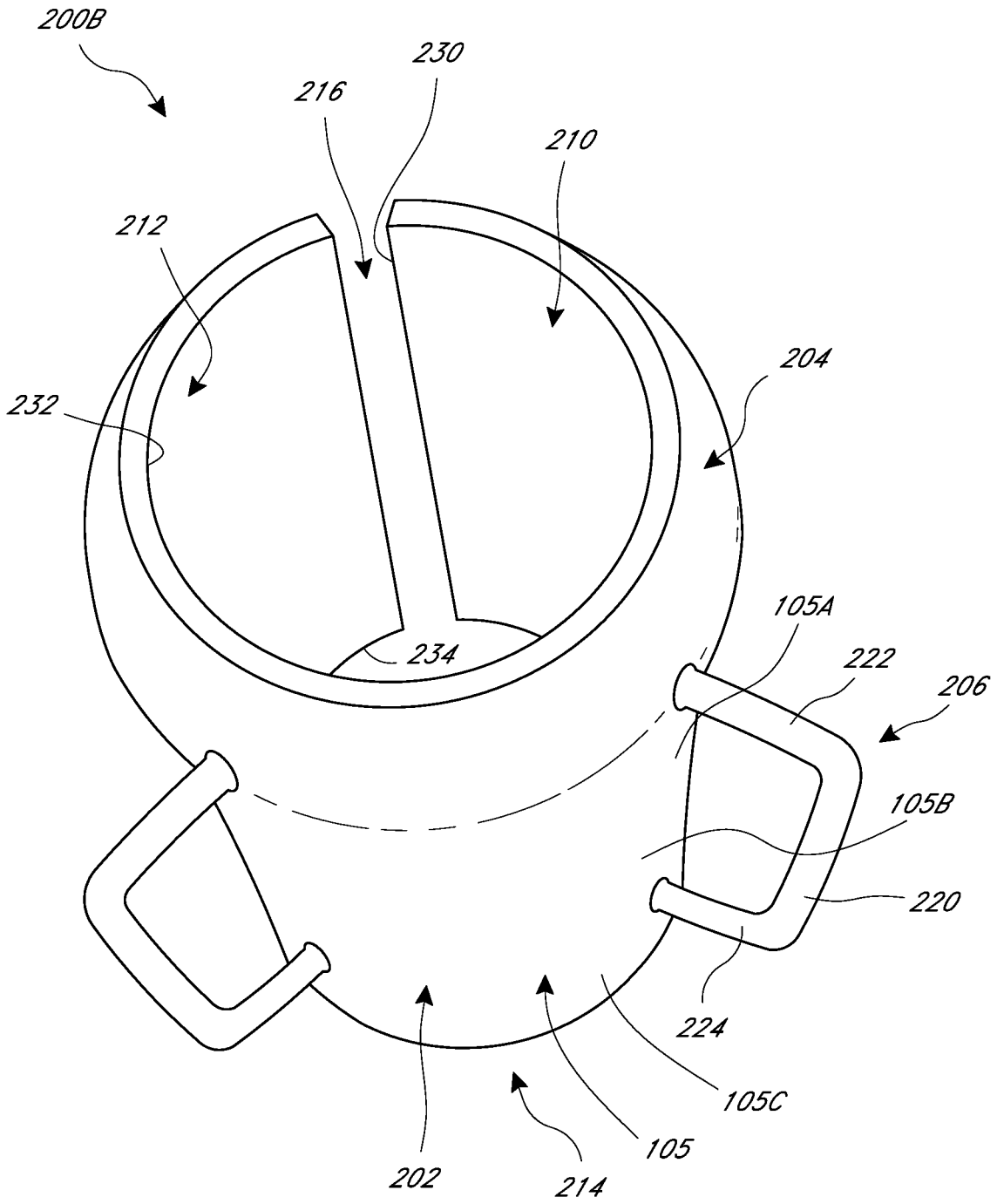
FIG. 5B illustrates a perspective view of the bottle another embodiment of a bottle support system.
Figure 6:
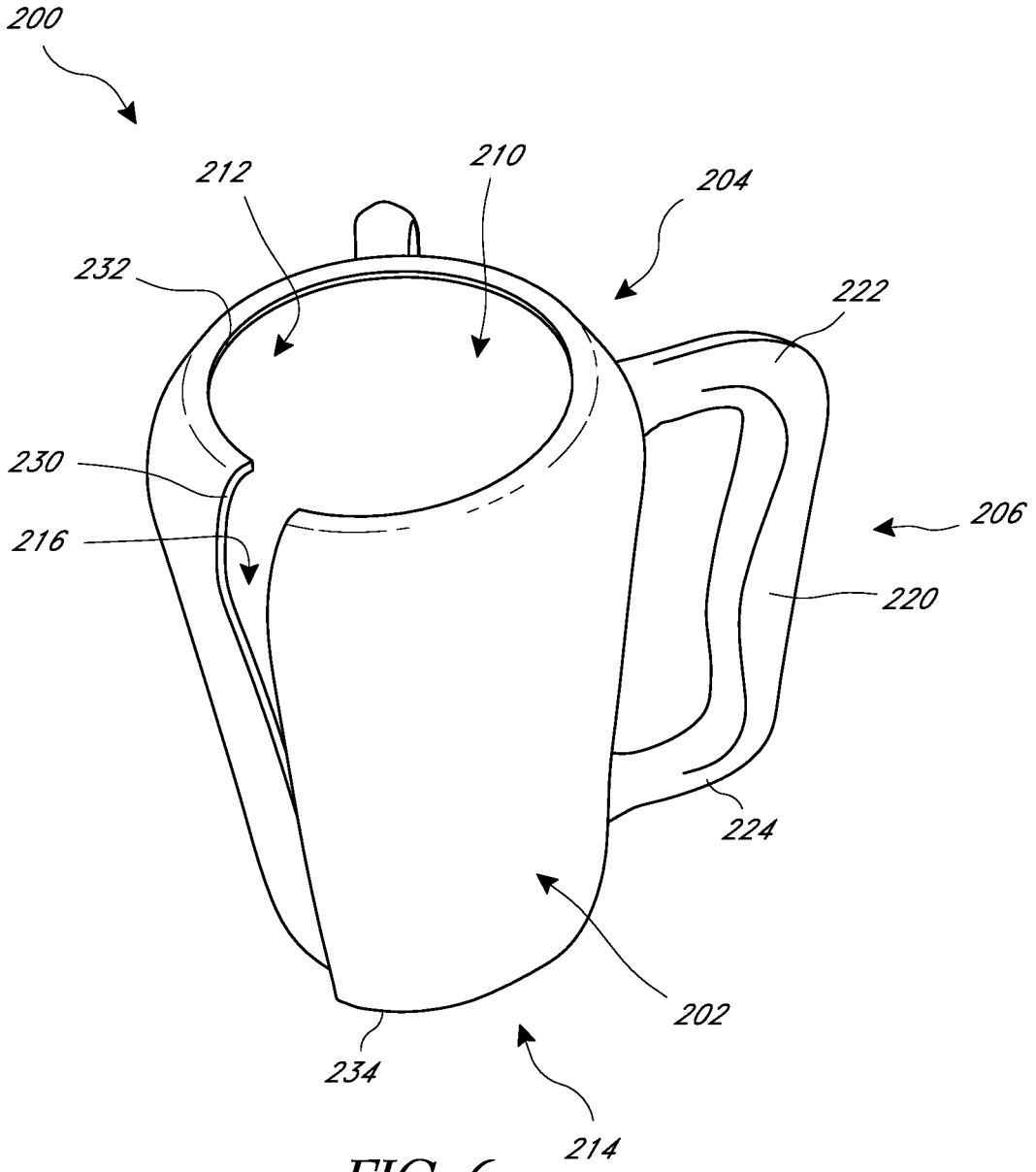
FIG. 6 illustrates a perspective view of the bottle support system of FIG. 5.
Figure 6A:
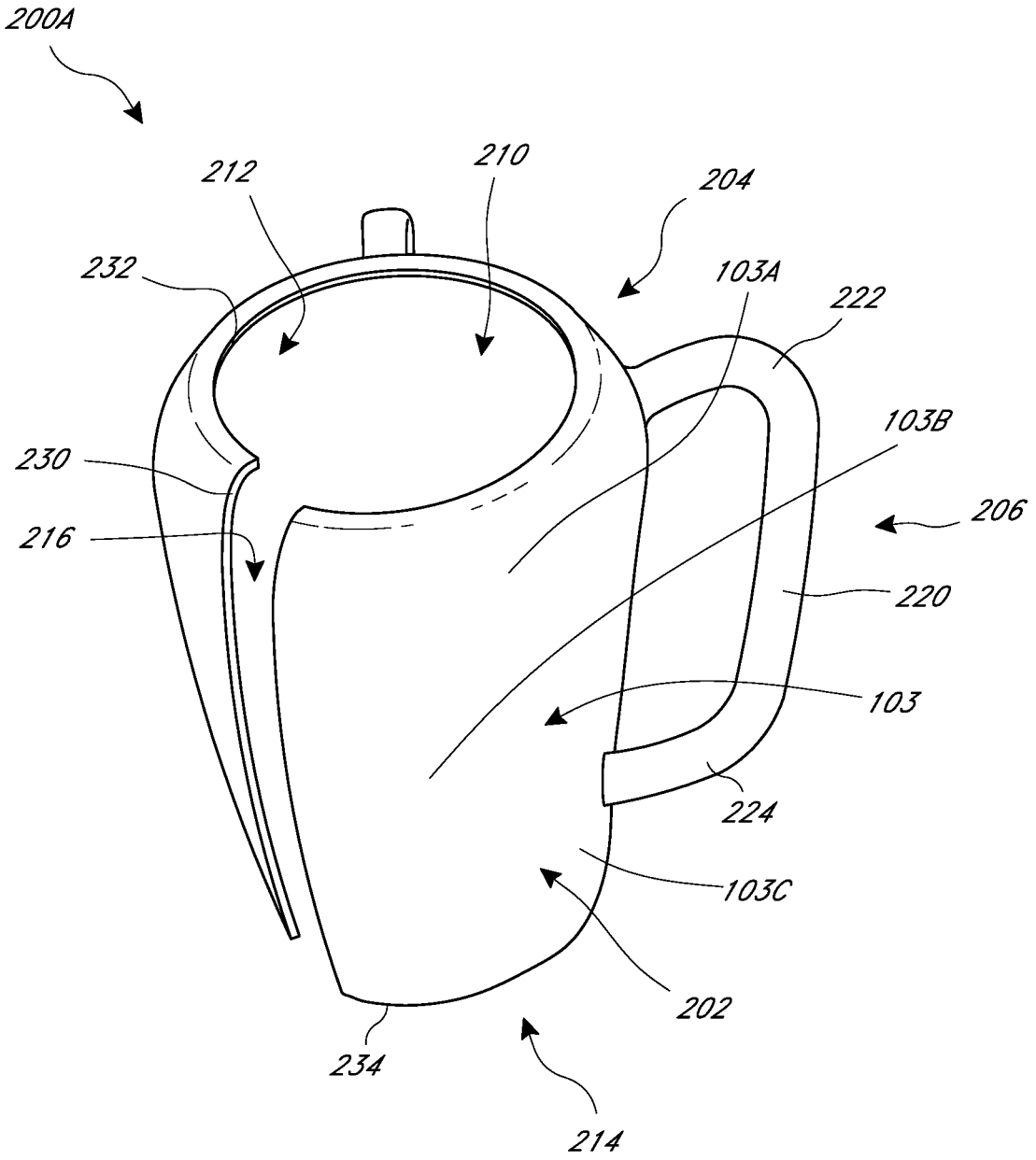
FIG. 6A illustrates a perspective view of the bottle support system of FIG. 5A.
Figure 6B:
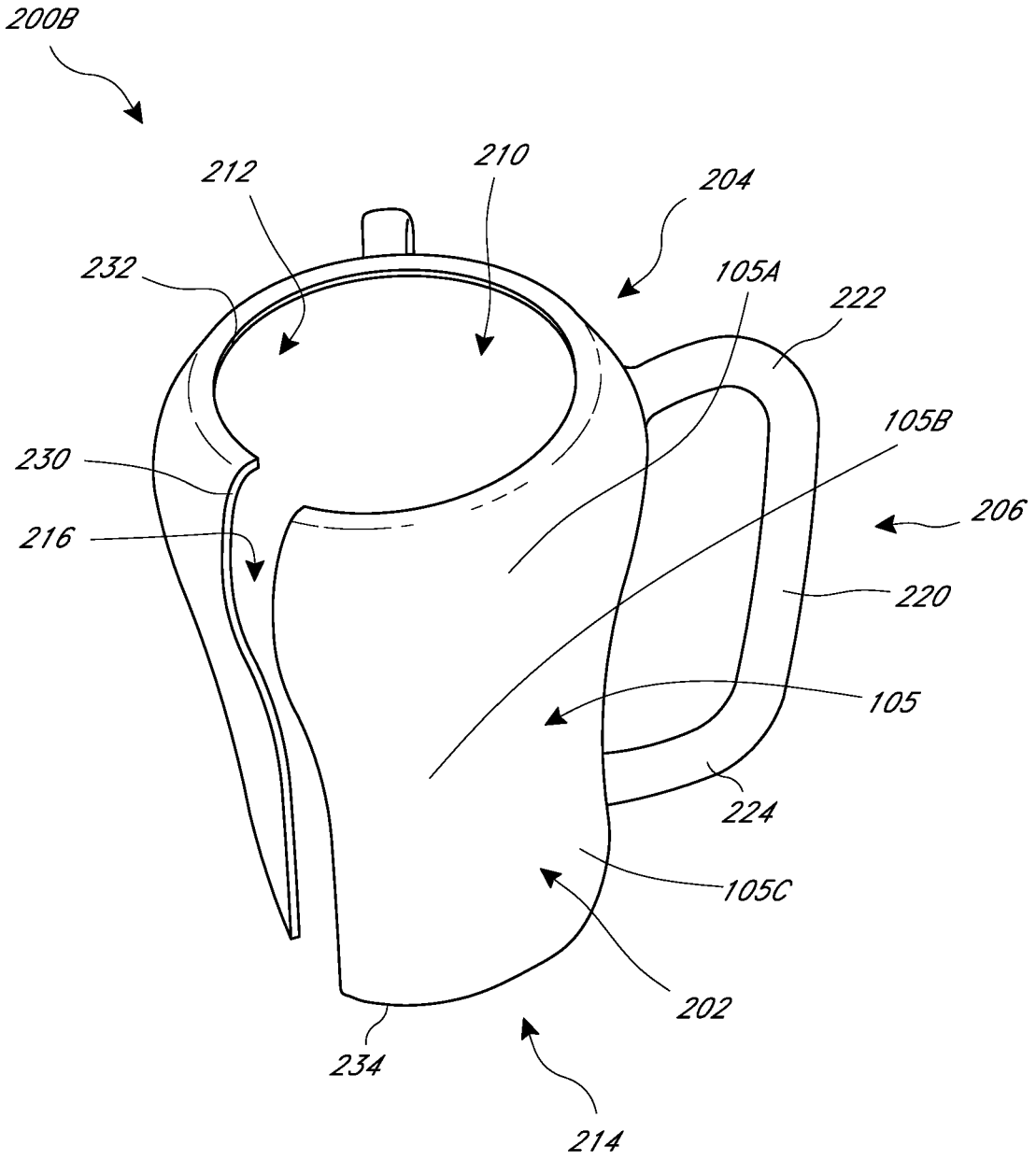
FIG. 6B illustrates a perspective view of the bottle support system of FIG. 5B.

FIG. 5 illustrates a perspective view of another embodiment of a baby bottle support system 200. With reference to FIGS. 5 and 6, in some embodiments, a baby bottle support system 200 can include a support body 202 having a generally cylindrical portion. The support body 202 preferably has an upper curved section forming a neck portion 204. First and second handle portions 206 are coupled to the support body 202.

A channel 210 is defined within the support body 202 extending between a first opening 212 and a second opening 214. The first opening 212 is generally defined by a first rim 232 of the neck portion 204 at a first end portion. The second opening 214 is generally defined by a second rim 234 of the support body 202 at a second end portion. A slot 216 is generally defined between slot edges 230 of the support body 202 extending between the first end portion and the second end portion.

The first and second handle portions 206 have handle grip portions 220 and handle attachment portions 222, 224. The first and second handle portions 206 are preferably coupled to the support body 202 at an angle less than 180 degrees apart from each other about a surface of the support body 202. In some embodiments, the first and second handle portions are coupled to the support body at an angle less than 150 degrees apart from each other about a surface of the support body. In some embodiments, the first and second handle portions are coupled to the support body at an angle less than 120 degrees apart from each other about a surface of the support body. In some embodiments, the first and second handle portions are coupled to the support body at an angle less than 90 degrees apart from each other about a surface of the support body. In some embodiments, the first and second handle portions are coupled to the support body at an angle less than 60 degrees apart from each other about a surface of the support body.

In some embodiments, the first and second handle portions 206 are coupled to the support body between about 120 degrees and about 60 degrees apart from each other about a surface of the support body. In some embodiments, the first and second handle portions are coupled to the support body between about 90 degrees and about 60 degrees apart from each other about a surface of the support body.

In some embodiments, the first and second handle portions 206 are coupled to the support body at an angle less than 180 degrees apart from the slot about a surface of the support body. In some embodiments, the first and second handle portions are coupled to the support body at an angle less than 150 degrees apart from the slot about a surface of the support body.

In some embodiments, the first and second handle portions 206 are coupled to the support body at an angle less than 120 degrees apart from the slot about a surface of the support body. In some embodiments, the first and second handle portions are coupled to the support body between about 150 degrees and about 90 degrees apart from the slot about a surface of the support body. In some embodiments, the first and second handle portions are coupled to the support body between about 150 degrees and about 120 degrees apart from the slot about a surface of the support body.

In some embodiments, the handle grip portions 220 are coupled to the support body generally parallel to a surface of the support body 202. In some embodiments, the handle grip portions are coupled to the support body at an angle relative to a surface of the support body. In some embodiments, the handle grip portions are coupled to the support body at an angle between about 5 degrees and about 30 degrees relative to a surface of the support body. In some embodiments, the handle grip portions are coupled to the support body at an angle between about 10 degrees and about 20 degrees relative to a surface of the support body. In some embodiments, the handle grip portions are coupled to the support body at an angle of about 15 degrees relative to a surface of the support body.

In some embodiments, the first opening 212 generally defines a first opening cross-sectional area, and the second opening 214 generally defines a second opening cross-sectional area, where the second opening cross-sectional area is greater than the first opening cross-sectional area.

Figure 7:
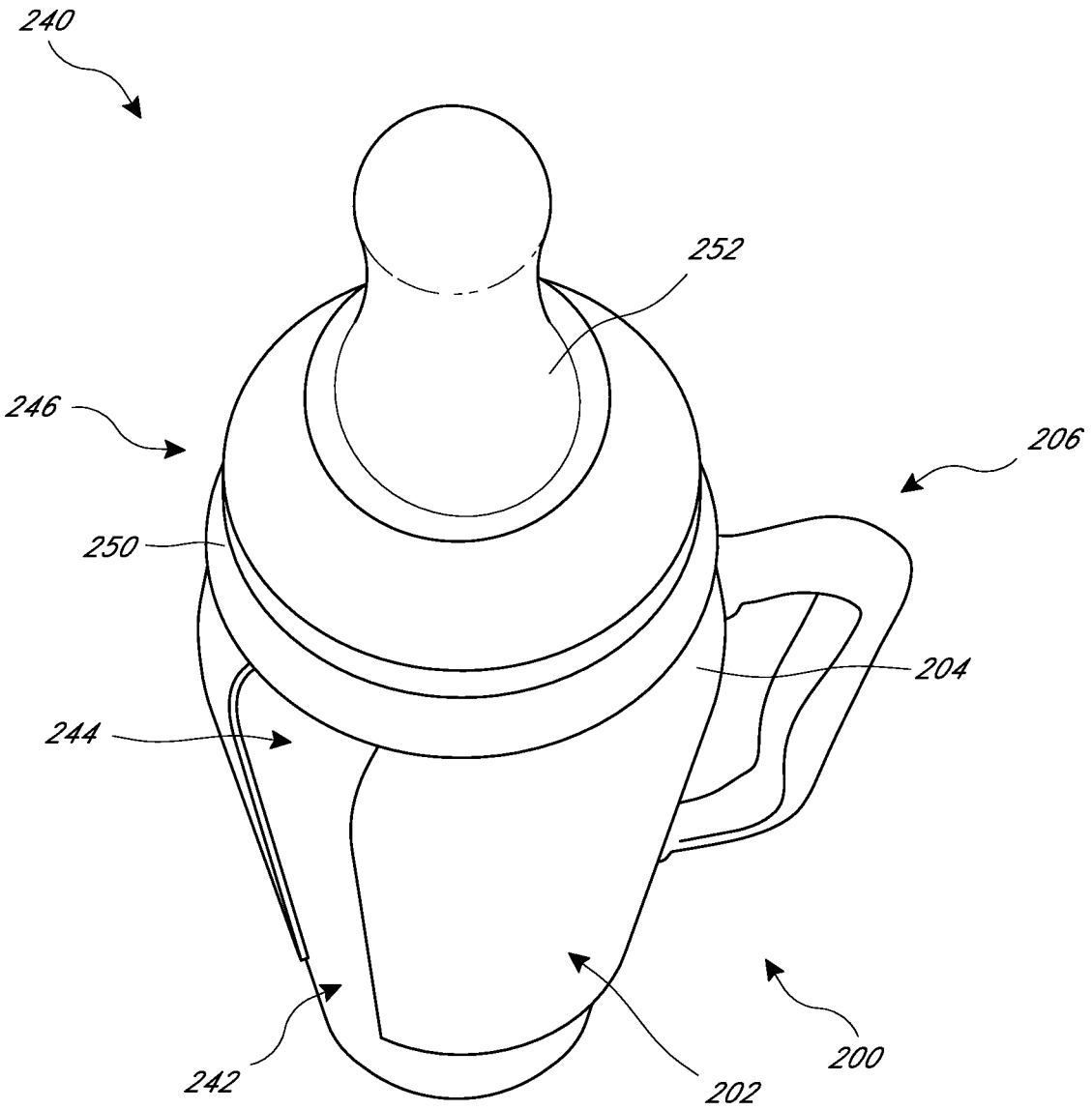
FIG. 7 illustrates a perspective view of the bottle support system of FIG. 5 coupled to a bottle system.
Figure 7A:
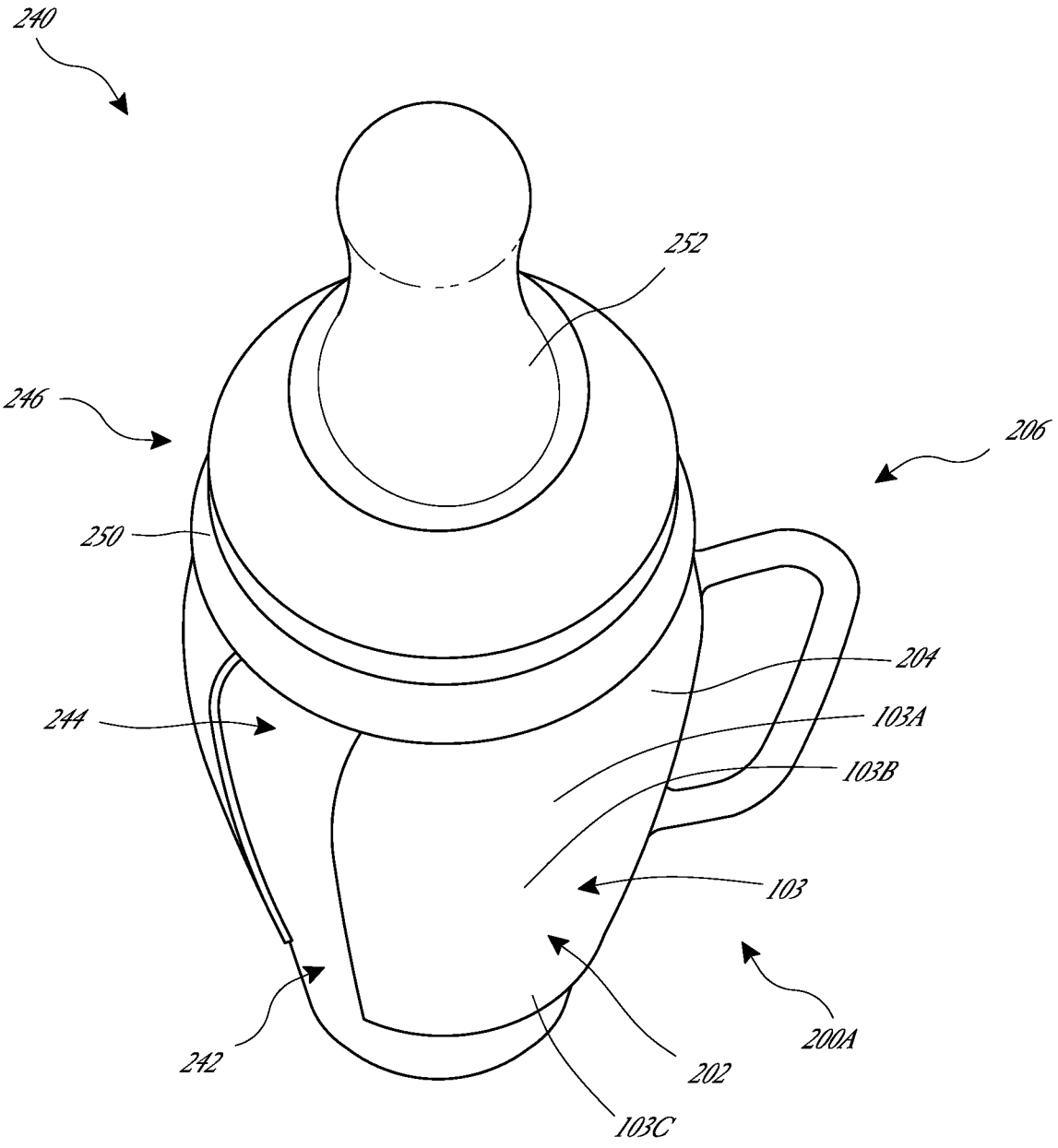
FIG. 7A illustrates a perspective view of the bottle support system of FIG. 5A coupled to a bottle system.
Figure 7B:
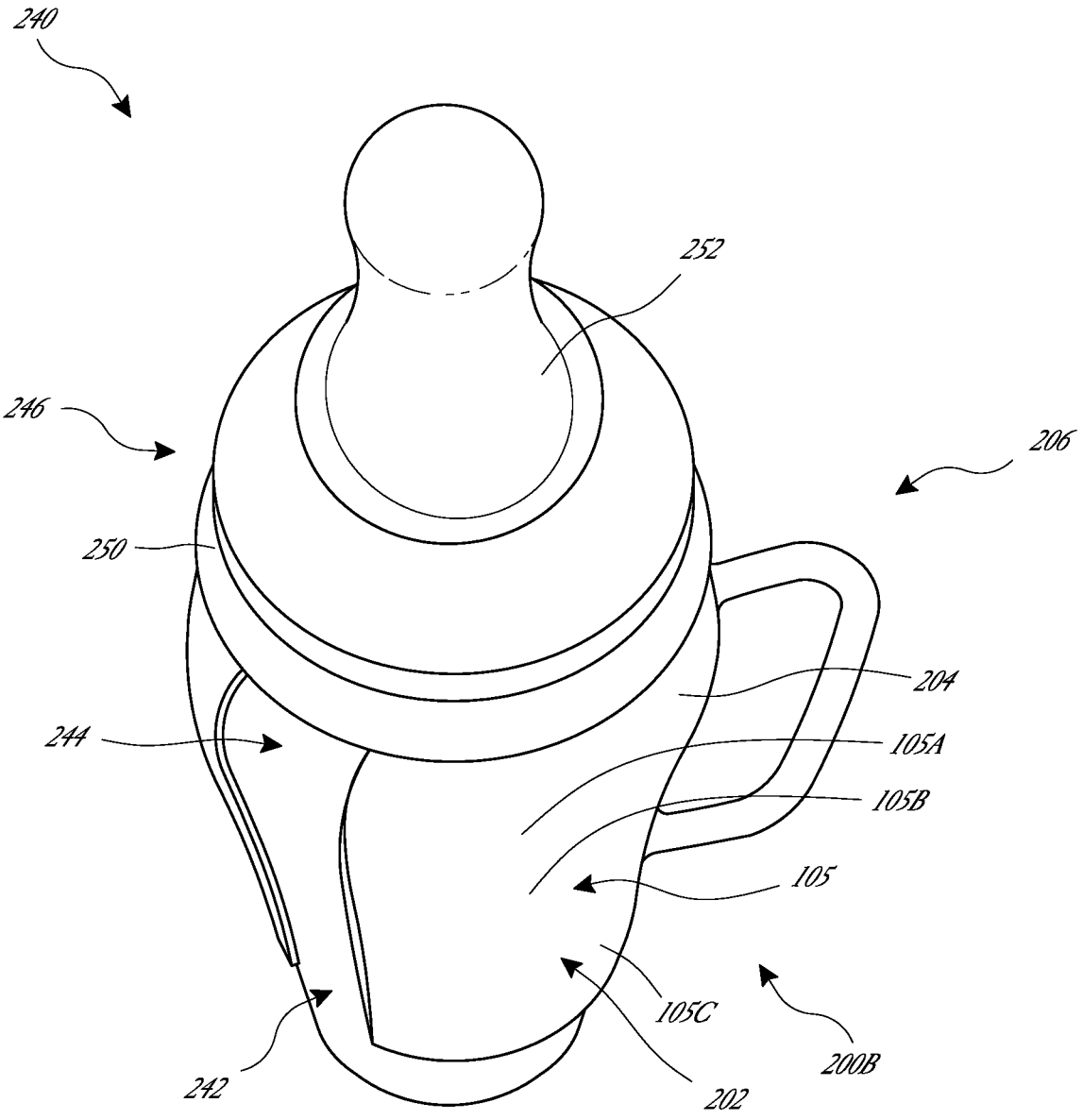
FIG. 7B illustrates a perspective view of the bottle support system of FIG. 5B coupled to a bottle system.
Figure 8:
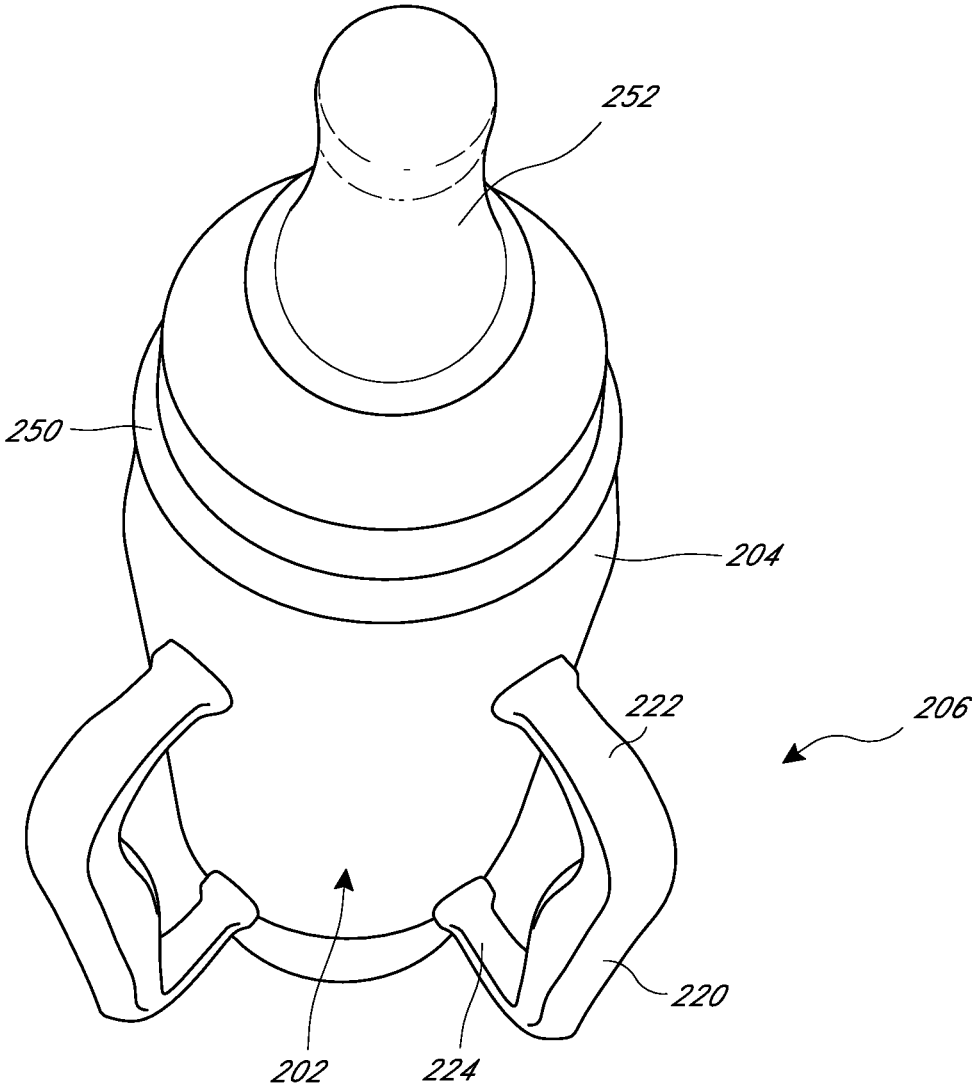
FIG. 8 illustrates a perspective view of the bottle support system of FIG. 5 coupled to a bottle system.
Figure 8A:
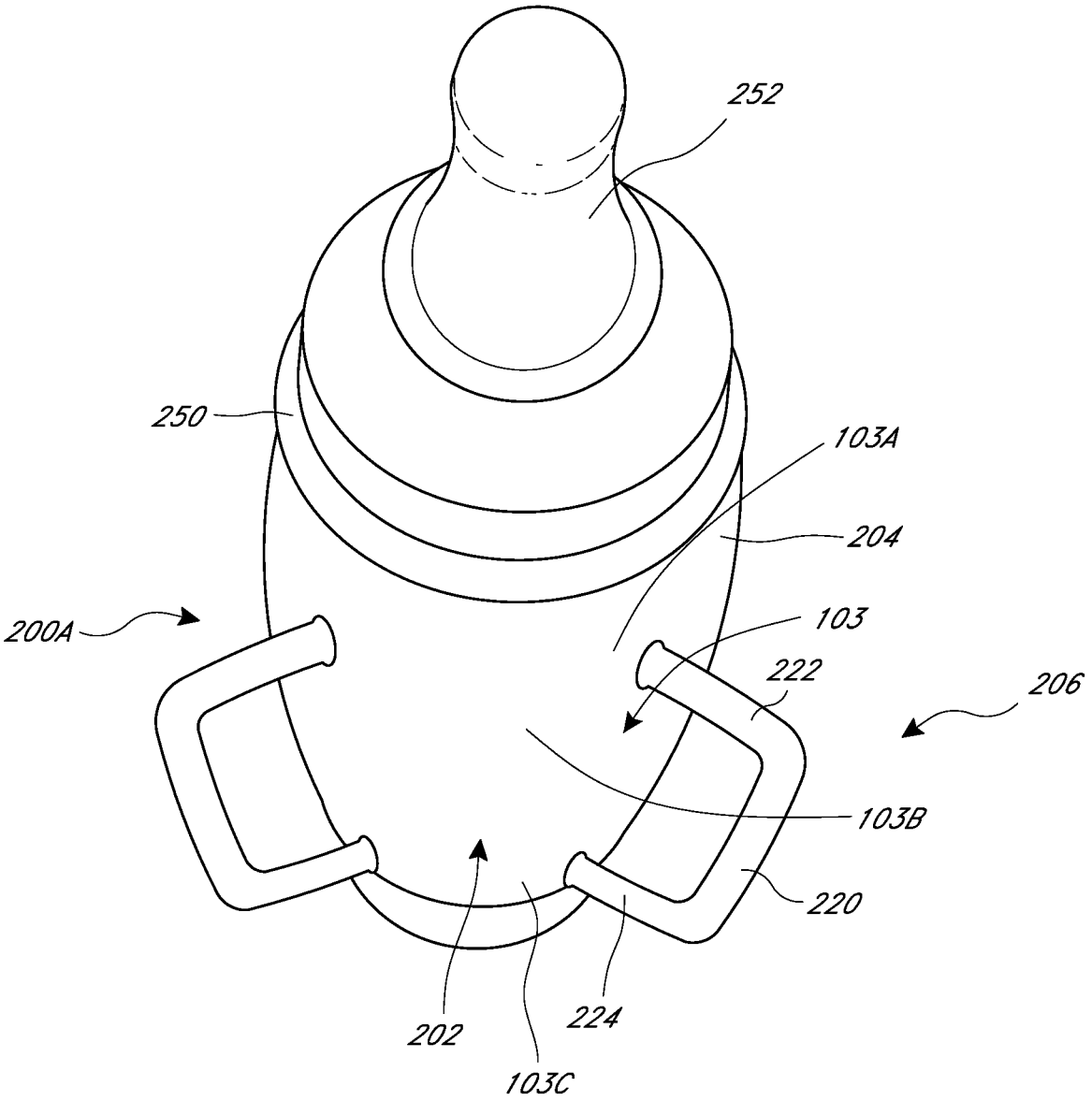
FIG. 8A illustrates a perspective view of the bottle support system of FIG. 5A coupled to a bottle system.
Figure 8B:
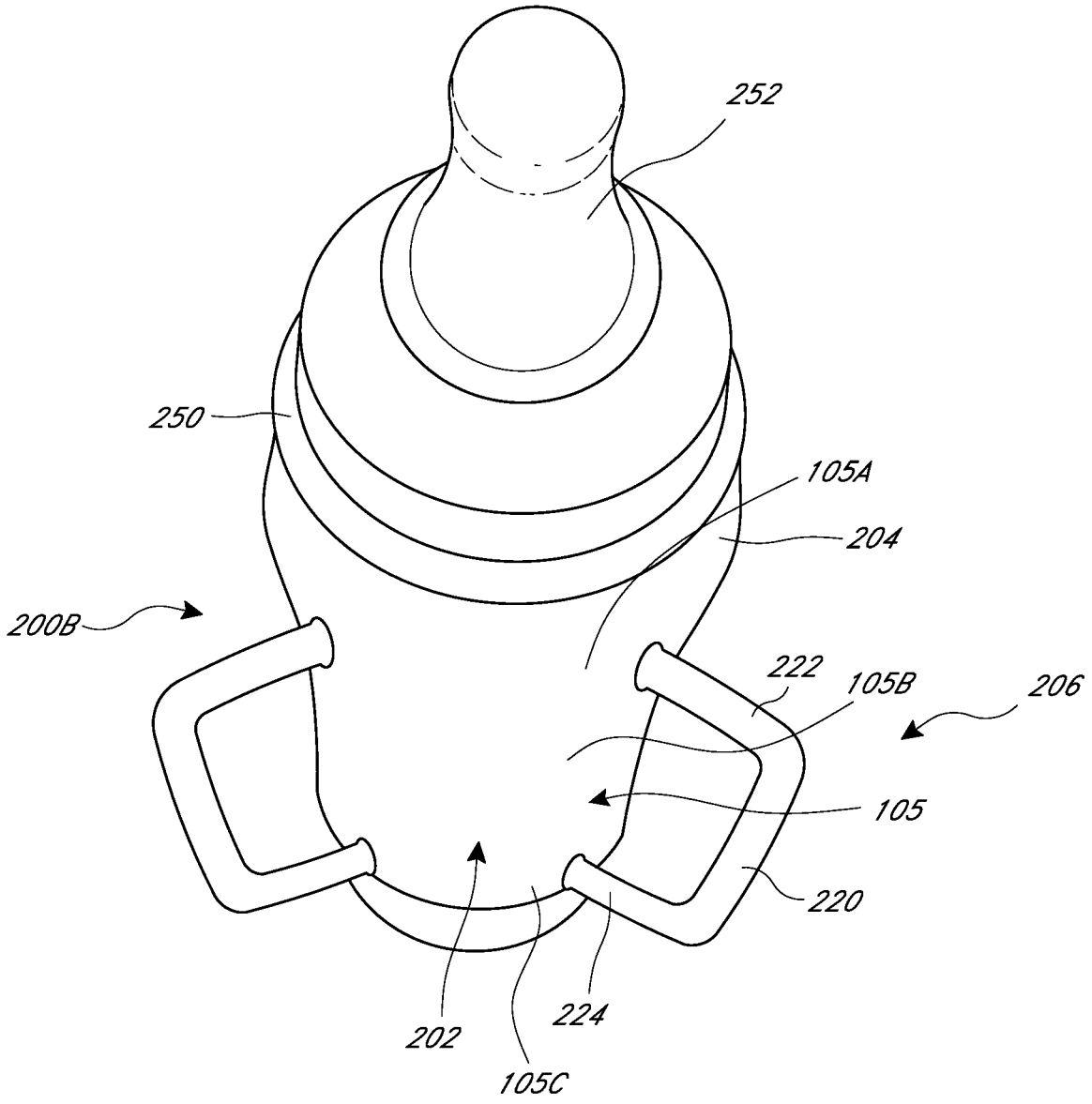
FIG. 8B illustrates a perspective view of the bottle support system of FIG. 5B coupled to a bottle system.

With reference to FIGS. 7 and 8, the support body 202 is preferably sized and configured to receive, releasably grip, and support a baby bottle positioned within the channel 210 defined within the support body 202. For example, a baby bottle system 240 can include a bottle body 242, a bottle neck 244, and a cap system 246. In some embodiments, the cap system 246 can include a cap attachment 250, and a nipple portion 252. The system can be used and/or modified as described in connection with other embodiments and variations disclosed herein.

FIGS. 1A, 2A, 3A, and 4A illustrate a bottle support system 100A. In some embodiments, the bottle support system 100A is an alternative embodiment of the bottle support system 100 in which the support body 102 includes a convex or generally convex portion 103 instead of a generally cylindrical portion. In some embodiments, the convex or generally convex portion 103 can extend between the neck portion 104 and the second rim 134 of the support body 102.

In some embodiments, a middle portion 103B of the convex or generally convex portion 103 can have a cross-sectional area larger than a cross-sectional area of a superior portion 103A of the convex or generally convex portion 103 positioned between the middle portion 103B and the neck portion 104 and larger than a cross-sectional area of an inferior portion 103C of the convex or generally convex portion positioned between the middle portion 103B and the second end portion.

In some embodiments, a cross-sectional area of the convex or generally convex portion 103 narrows from a middle portion 103B of the convex or generally convex portion 103 to the neck portion. In some embodiments, a cross-section area of the convex or generally convex portion 103 narrows from the middle portion 103B of the convex or generally convex portion 103 to the second end portion.

In some embodiments, a middle portion 103B of the convex or generally convex portion 103 can have a cross-sectional area larger than a cross-sectional area at a top end of the convex or generally convex portion 103 and larger than a cross-sectional area at a bottom end of the convex or generally convex portion 103. In some embodiments, the top end of the convex or generally convex portion 103 is coupled to the neck portion 104. In some embodiments, the bottom end of the convex or generally convex portion 103 defines the second rim 134.

In some embodiments, a middle portion 103B of the convex or generally convex portion 103 can have a cross-sectional area larger than a cross-sectional area at the first end portion of the support body 102 and larger than a cross-sectional area at the second end portion of the support body 102.

In some embodiments, a middle portion 103B of the convex or generally convex portion 103 can have a cross-sectional area larger than a cross-sectional area of the first rim 132 and larger than a cross-sectional area of the second rim 134.

In some embodiments, a middle portion 103B of the convex or generally convex portion 103 can have a cross-sectional area larger than a largest cross-sectional area of the neck portion 104 and larger than the cross-sectional area of the second rim 134.

In some embodiments, a middle portion 103B of the convex or generally convex portion 103 can have a cross-sectional area larger than a cross-sectional area of the bottom most portion of the neck portion 104 and larger than the cross-sectional area of the second rim 134.

The convex or generally convex portion 103 of the support body 102 of the bottle support system 100A can facilitate the receipt, gripping, and support of baby bottles having different shapes and/or sizes than the generally cylindrical portion of the support body 102 of the bottle support system 100. For example, in some embodiments, the convex or generally convex portion 103 can receive, grip and support convex bottles. In some embodiments, the convex or generally convex portion 103 of the support body 102 can have a shape that corresponds to the shape of a convex bottle. In other embodiments, the shape of the convex or generally convex portion 103 does not correspond to the shape of the bottle. For example, in some embodiments, the convex or generally convex portion 103 can receive a cylindrical or concave bottle. In some embodiments, the convex or generally convex portion 103 can be sized, shaped, and/or otherwise configured to establish a friction fit with a bottle to secure the bottle within the support body 102. A friction fit can improve manipulation and provided enhanced safety by securely gripping the bottle.

The bottle support system 100A can include any of the same or similar features or functions as the embodiment of the bottle support system 100 described with respect to FIGS. 1, 2, 3, and 4.

For example, in the bottle support system 100A shown in FIGS. 1A, 2A, 3A, and 4A, the first and second handle portions 106 can be coupled to the support body 102 at an angle less than 180 degrees apart from each other about a surface of the support body 102. In some embodiments, the first and second handle portions are coupled to the support body at an angle less than 170 degrees apart from each other about a surface of the support body. In some embodiments, the first and second handle portions are coupled to the support body at an angle less than 160 degrees apart from each other about a surface of the support body. In some embodiments, the first and second handle portions are coupled to the support body at an angle less than 150 degrees apart from each other about a surface of the support body. In some embodiments, the first and second handle portions are coupled to the support body at an angle less than 140 degrees apart from each other about a surface of the support body. In some embodiments, the first and second handle portions are coupled to the support body at an angle less than 130 degrees apart from each other about a surface of the support body. In some embodiments, the first and second handle portions are coupled to the support body at an angle less than 120 degrees apart from each other about a surface of the support body. In some embodiments, the first and second handle portions are coupled to the support body at an angle less than 110 degrees apart from each other about a surface of the support body. In some embodiments, the first and second handle portions are coupled to the support body at an angle less than 100 degrees apart from each other about a surface of the support body. In some embodiments, the first and second handle portions are coupled to the support body at an angle less than 90 degrees apart from each other about a surface of the support body. In some embodiments, the first and second handle portions are coupled to the support body at an angle less than 80 degrees apart from each other about a surface of the support body. In some embodiments, the first and second handle portions are coupled to the support body at an angle less than 70 degrees apart from each other about a surface of the support body. In some embodiments, the first and second handle portions are coupled to the support body at an angle less than 60 degrees apart from each other about a surface of the support body. In some embodiments, the first and second handle portions are coupled to the support body at an angle less than 50 degrees apart from each other about a surface of the support body. In some embodiments, the first and second handle portions are coupled to the support body at an angle less than 45 degrees apart from each other about a surface of the support body. In some embodiments, the first and second handle portions are coupled to the support body at an angle less than 40 degrees apart from each other about a surface of the support body. In some embodiments, the first and second handle portions are coupled to the support body at an angle less than 30 degrees apart from each other about a surface of the support body.

In some embodiments, the first and second handle portions 106 are coupled to the support body between about 180 degrees and about 120 degrees apart from each other about a surface of the support body. In some embodiments, the first and second handle portions 106 are coupled to the support body between about 180 degrees and about 150 degrees apart from each other about a surface of the support body. In some embodiments, the first and second handle portions 106 are coupled to the support body between about 150 degrees and about 120 degrees apart from each other about a surface of the support body. In some embodiments, the first and second handle portions 106 are coupled to the support body between about 120 degrees and about 60 degrees apart from each other about a surface of the support body. In some embodiments, the first and second handle portions 106 are coupled to the support body between about 120 degrees and about 90 degrees apart from each other about a surface of the support body. In some embodiments, the first and second handle portions are coupled to the support body between about 90 degrees and about 60 degrees apart from each other about a surface of the support body. In some embodiments, the first and second handle portions are coupled to the support body between about 80 degrees and about 60 degrees apart from each other about a surface of the support body. In some embodiments, the first and second handle portions are coupled to the support body between about 80 degrees and about 65 degrees apart from each other about a surface of the support body. In some embodiments, the first and second handle portions are coupled to the support body between about 75 degrees and about 65 degrees apart from each other about a surface of the support body. In some embodiments, the first and second handle portions are coupled to the support body between about 75 degrees and about 70 degrees apart from each other about a surface of the support body. In some embodiments, the first and second handle portions are coupled to the support body between about 60 degrees and about 30 degrees apart from each other about a surface of the support body. In some embodiments, the first and second handle portions are coupled to the support body between about 55 degrees and about 35 degrees apart from each other about a surface of the support body. In some embodiments, the first and second handle portions are coupled to the support body between about 50 degrees and about 40 degrees apart from each other about a surface of the support body. The angle at which the first handle portion 106 and second handle portion 108 are spaced apart from each other about a surface of the support body is shown as angle $\alpha$ in FIG. 3A.

In some embodiments, the first and second handle portions 106 are coupled to the support body at an angle less than 180 degrees apart from the slot about a surface of the support body. In some embodiments, the first and second handle portions are coupled to the support body at an angle less than 170 degrees apart from the slot about a surface of the support body. In some embodiments, the first and second handle portions are coupled to the support body at an angle less than 160 degrees apart from the slot about a surface of the support body. In some embodiments, the first and second handle portions are coupled to the support body at an angle less than 150 degrees apart from the slot about a surface of the support body. In some embodiments, the first and second handle portions are coupled to the support body at an angle less than 140 degrees apart from the slot about a surface of the support body. In some embodiments, the first and second handle portions are coupled to the support body at an angle less than 130 degrees apart from the slot about a surface of the support body. In some embodiments, the first and second handle portions 106 are coupled to the support body at an angle less than 120 degrees apart from the slot about a surface of the support body. In some embodiments, the first and second handle portions 106 are coupled to the support body at an angle less than 110 degrees apart from the slot about a surface of the support body. In some embodiments, the first and second handle portions 106 are coupled to the support body at an angle less than 100 degrees apart from the slot about a surface of the support body. In some embodiments, the first and second handle portions 106 are coupled to the support body at an angle less than 90 degrees apart from the slot about a surface of the support body.

In some embodiments, the first and second handle portions are coupled to the support body between about 180 degrees and about 150 degrees apart from the slot about a surface of the support body. In some embodiments, the first and second handle portions are coupled to the support body between about 165 degrees and about 125 degrees apart from the slot about a surface of the support body. In some embodiments, the first and second handle portions are coupled to the support body between about 155 degrees and about 135 degrees apart from the slot about a surface of the support body. In some embodiments, the first and second handle portions are coupled to the support body between about 150 degrees and about 140 degrees apart from the slot about a surface of the support body. In some embodiments, the first and second handle portions are coupled to the support body between about 150 degrees and about 90 degrees apart from the slot about a surface of the support body. In some embodiments, the first and second handle portions are coupled to the support body between about 150 degrees and about 120 degrees apart from the slot about a surface of the support body. In some embodiments, the first and second handle portions are coupled to the support body between about 120 degrees and about 90 degrees apart from the slot about a surface of the support body. The angle at which one of the first and second handle portions and the slot are spaced apart from each other about a surface of the support body is shown as angle β in FIG. 3A.

As shown in FIGS. 1A, 2A, 3A, and 4A, in some embodiments, the handle portions 106 can be cylindrical or generally cylindrical. In some embodiments, the grip portion 120 can be cylindrical or generally cylindrical. In some embodiments, the handle portions 106 can have a circular or generally circular cross-section. In some embodiments, the grip portions 120 can have a circular of generally circular cross-section. In some embodiments, the grip portions 120 of the system 100A can facilitate gripping by a smaller hand than the grip portions 120 of system 100 shown in FIGS. 1, 2, 3, and 4. In some embodiments, the grip portions 120 of system 100A can be used in the system 100 shown in FIGS. 1, 2, 3, and 4.

FIGS. 5A, 6A, 7A, and 8A, illustrate an embodiment of a bottle support system 200A. In some embodiments, the bottle support system 200A is an alternative embodiment of the bottle support system 200 in which the support body 202 includes a convex or generally convex portion 103 instead of a generally cylindrical portion. In some embodiments, the convex or generally convex portion 103 can extend between the neck portion 204 and the second rim 234 of the support body 202.

In some embodiments, a middle portion of the convex or generally convex portion 103 can have a cross-sectional area larger than a cross-sectional area of a superior portion 103A of the convex or generally convex portion 103 positioned between the middle portion 103B and the neck portion 204 and larger than a cross-sectional area of an inferior portion 103C of the convex or generally convex portion 103 positioned between the middle portion 103B and the second end portion.

In some embodiments, a cross-sectional area of the convex or generally convex portion 103 narrows from a middle portion of the convex or generally convex portion 103 to the neck portion. In some embodiments, a cross-section area of the convex or generally convex portion 103 narrows from the middle portion 103B of the convex or generally convex portion 103 to the second end portion.

In some embodiments, a middle portion 103B of the convex or generally convex portion 103 can have a cross-sectional area larger than a cross-sectional area at a top end of the convex or generally convex portion 103 and larger than a cross-sectional area at a bottom end of the convex or generally convex portion 103. In some embodiments, the top end of the convex or generally convex portion 103 is coupled to the neck portion 204. In some embodiments, the bottom end of the convex or generally convex portion defines the second rim 234.

In some embodiments, a middle portion 103B of the convex or generally convex portion 103 can have a cross-sectional area larger than a cross-sectional area at the first end portion of the support body 202 and larger than a cross-sectional area at the second end portion of the support body 202.

In some embodiments, a middle portion 103B of the convex or generally convex portion 103 can have a cross-sectional area larger than a cross-sectional area of the first rim 232 and larger than a cross-sectional area of the second rim 234.

In some embodiments, a middle portion 103B of the convex or generally convex portion 103 can have a cross-sectional area larger than a largest cross-sectional area of the neck portion 204 and larger than the cross-sectional area of the second rim 234.

In some embodiments, a middle portion 103B of the convex or generally convex portion 103 can have a cross-sectional area larger than a cross-sectional area of the bottom most portion of the neck portion 204 and larger than the cross-sectional area of the second rim 234.

The convex or generally convex portion 103 of the support body 202 of the bottle support system 200A can facilitate the receipt, gripping, and support of baby bottles having different shapes and/or sizes than the generally cylindrical portion of the support body 202 of the bottle support system 200. For example, in some embodiments, the convex or generally convex portion 103 can receive, grip and support convex bottles. In some embodiments, the convex or generally convex portion 103 of the support body 202 can have a shape that corresponds to the shape of a convex bottle. In other embodiments, the shape of the convex or generally convex portion 103 does not correspond to the shape of the bottle. For example, in some embodiments, the convex or generally convex portion 103 can receive a cylindrical or concave bottle. In some embodiments, the convex or generally convex portion 103 can be sized, shaped, and/or otherwise configured to establish a friction fit with a bottle to secure the bottle within the support body 202. A friction fit can improve manipulation and provided enhanced safety by securely gripping the bottle.

The bottle support system 200A can include any of the same or similar features or functions as the embodiment of the bottle support system 200 described with respect to FIGS. 5, 6, 7, and 8.

As shown in FIGS. 5A, 6A, 7A, and 8A, in some embodiments, the handle portions 206 can be cylindrical or generally cylindrical. In some embodiments, the grip portion 220 can be cylindrical or generally cylindrical. In some embodiments, the handle portions 206 can have a circular or generally circular cross-section. In some embodiments, the grip portions 220 can have a circular of generally circular cross-section. In some embodiments, the grip portions 220 of the system 200A can facilitate gripping by a smaller hand than the grip portions 220 of system 200 shown in FIGS. 5, 6, 7, and 8. In some embodiments, the grip portions 220 of system 200A can be used in the system 200 shown in FIGS. 5, 6, 7, and 8.

FIGS. 1B, 2B, 3B, and 4B illustrate a bottle support system 100B. In some embodiments, the bottle support system 100B is an alternative embodiment of the bottle support system 100 in which the support body 102 includes a concave or generally concave portion 105 instead of a generally cylindrical portion. In some embodiments, the concave or generally concave portion 105 can extend between the neck portion 104 and the second rim 134 of the support body 102.

In some embodiments, a middle portion 105B of the concave or generally concave portion 105 can have a cross-sectional area smaller than a cross-sectional area of a superior portion 105A of the concave or generally concave portion 105 positioned between the middle portion 105B and the neck portion 104 and smaller than a cross-sectional area of an inferior portion 105C of the concave or generally concave portion 105 positioned between the middle portion 105B and the second end portion.

In some embodiments, a cross-sectional area of the concave or generally concave portion 105 widens from a middle portion 105B of the concave or generally concave portion 105 to the neck portion. In some embodiments, a cross-section area of the concave or generally concave 105 widens from the middle portion 105B of the concave or generally concave portion 105 to the second end portion.

In some embodiments, a middle portion 105B of the concave or generally concave portion 105 can have a cross-sectional area smaller than a cross-sectional area at a top end of the concave or generally concave portion 105 and smaller than a cross-sectional area at a bottom end of the concave or generally concave portion 105. In some embodiments, the top end of the concave or generally concave portion 105 is coupled to the neck portion 104. In some embodiments, the bottom end of the concave or generally concave portion 105 defines the second rim 134.

In some embodiments, a middle portion 105B of the concave or generally concave portion 105 can have a cross-sectional area smaller than a cross-sectional area at the first end portion of the support body 102 and smaller than a cross-sectional area at the second end portion of the support body 102. In other embodiments, the cross-sectional area of one or both of the first end portion and the second end portion is smaller than the cross-sectional area of the middle portion 105B.

In some embodiments, a middle portion 105B of the concave or generally concave portion 105 can have a cross-sectional area smaller than a cross-sectional area of the first rim 132 and smaller than a cross-sectional area of the second rim 134. In other embodiments, the cross-sectional area of one or both of the first rim 132 and the second rim 134 is smaller than the cross-sectional area of the middle portion 105B.

In some embodiments, a middle portion 105B of the concave or generally concave portion 105 can have a cross-sectional area smaller than a smallest cross-sectional area of the neck portion 104 and smaller than the cross-sectional area of the second rim 134. In other embodiments, the smallest cross-sectional area of the neck support 104 is smaller than the cross-sectional area of the middle portion 105B.

In some embodiments, a middle portion 105B of the concave or generally concave portion 105 can have a cross-sectional area smaller than a cross-sectional area of the bottom most portion of the neck portion 104 and smaller than the cross-sectional area of the second rim 134.

The concave or generally concave portion 105 of the support body 102 of the bottle support system 100B can facilitate the receipt, gripping, and support of baby bottles having different shapes and/or sizes than the generally cylindrical portion of the support body 102 of the bottle support system 100. For example, in some embodiments, the concave or generally concave portion 105 can receive, grip and support concave bottles. In some embodiments, the concave or generally concave portion 105 of the support body 102 can have a shape that corresponds to the shape of a concave bottle. In other embodiments, the shape of the concave or generally concave portion 105 does not correspond to the shape of the bottle. For example, in some embodiments, the concave or generally concave portion 105 can receive a cylindrical or convex bottle. In some embodiments, the concave or generally concave portion 105 can be sized, shaped, and/or otherwise configured to establish a friction fit with a bottle to secure the bottle within the support body 102. A friction fit can improve manipulation and provided enhanced safety by securely gripping the bottle.

The bottle support system 100B can include any of the same or similar features or functions as the embodiment of the bottle support system 100 described with respect to FIGS. 1, 2, 3, and 4.

For example, in the bottle support system 100B shown in FIGS. 1B, 2B, 3B, and 4B, the first and second handle portions 106 can be coupled to the support body 102 at an angle less than 180 degrees apart from each other about a surface of the support body 102. In some embodiments, the first and second handle portions are coupled to the support body at an angle less than 170 degrees apart from each other about a surface of the support body. In some embodiments, the first and second handle portions are coupled to the support body at an angle less than 160 degrees apart from each other about a surface of the support body. In some embodiments, the first and second handle portions are coupled to the support body at an angle less than 150 degrees apart from each other about a surface of the support body. In some embodiments, the first and second handle portions are coupled to the support body at an angle less than 140 degrees apart from each other about a surface of the support body. In some embodiments, the first and second handle portions are coupled to the support body at an angle less than 130 degrees apart from each other about a surface of the support body. In some embodiments, the first and second handle portions are coupled to the support body at an angle less than 120 degrees apart from each other about a surface of the support body. In some embodiments, the first and second handle portions are coupled to the support body at an angle less than 110 degrees apart from each other about a surface of the support body. In some embodiments, the first and second handle portions are coupled to the support body at an angle less than 100 degrees apart from each other about a surface of the support body. In some embodiments, the first and second handle portions are coupled to the support body at an angle less than 90 degrees apart from each other about a surface of the support body. In some embodiments, the first and second handle portions are coupled to the support body at an angle less than 80 degrees apart from each other about a surface of the support body. In some embodiments, the first and second handle portions are coupled to the support body at an angle less than 70 degrees apart from each other about a surface of the support body. In some embodiments, the first and second handle portions are coupled to the support body at an angle less than 60 degrees apart from each other about a surface of the support body. In some embodiments, the first and second handle portions are coupled to the support body at an angle less than 45 degrees apart from each other about a surface of the support body. In some embodiments, the first and second handle portions are coupled to the support body at an angle less than 40 degrees apart from each other about a surface of the support body. In some embodiments, the first and second handle portions are coupled to the support body at an angle less than 30 degrees apart from each other about a surface of the support body.

In some embodiments, the first and second handle portions 106 are coupled to the support body between about 180 degrees and about 120 degrees apart from each other about a surface of the support body. In some embodiments, the first and second handle portions 106 are coupled to the support body between about 180 degrees and about 150 degrees apart from each other about a surface of the support body. In some embodiments, the first and second handle portions 106 are coupled to the support body between about 150 degrees and about 120 degrees apart from each other about a surface of the support body. In some embodiments, the first and second handle portions 106 are coupled to the support body between about 120 degrees and about 60 degrees apart from each other about a surface of the support body. In some embodiments, the first and second handle portions 106 are coupled to the support body between about 120 degrees and about 90 degrees apart from each other about a surface of the support body. In some embodiments, the first and second handle portions are coupled to the support body between about 90 degrees and about 60 degrees apart from each other about a surface of the support body. In some embodiments, the first and second handle portions are coupled to the support body between about 80 degrees and about 60 degrees apart from each other about a surface of the support body. In some embodiments, the first and second handle portions are coupled to the support body between about 80 degrees and about 65 degrees apart from each other about a surface of the support body. In some embodiments, the first and second handle portions are coupled to the support body between about 75 degrees and about 65 degrees apart from each other about a surface of the support body. In some embodiments, the first and second handle portions are coupled to the support body between about 75 degrees and about 70 degrees apart from each other about a surface of the support body. In some embodiments, the first and second handle portions are coupled to the support body between about 60 degrees and about 30 degrees apart from each other about a surface of the support body. In some embodiments, the first and second handle portions are coupled to the support body between about 55 degrees and about 35 degrees apart from each other about a surface of the support body. In some embodiments, the first and second handle portions are coupled to the support body between about 50 degrees and about 40 degrees apart from each other about a surface of the support body. The angle at which the first handle portion 106 and second handle portion 108 are spaced apart from each other about a surface of the support body is shown as angle $\alpha$ in FIG. 3B.

In some embodiments, the first and second handle portions 106 are coupled to the support body at an angle less than 180 degrees apart from the slot about a surface of the support body. In some embodiments, the first and second handle portions are coupled to the support body at an angle less than 170 degrees apart from the slot about a surface of the support body. In some embodiments, the first and second handle portions are coupled to the support body at an angle less than 160 degrees apart from the slot about a surface of the support body. In some embodiments, the first and second handle portions are coupled to the support body at an angle less than 150 degrees apart from the slot about a surface of the support body. In some embodiments, the first and second handle portions are coupled to the support body at an angle less than 140 degrees apart from the slot about a surface of the support body. In some embodiments, the first and second handle portions are coupled to the support body at an angle less than 130 degrees apart from the slot about a surface of the support body. In some embodiments, the first and second handle portions 106 are coupled to the support body at an angle less than 120 degrees apart from the slot about a surface of the support body. In some embodiments, the first and second handle portions 106 are coupled to the support body at an angle less than 110 degrees apart from the slot about a surface of the support body. In some embodiments, the first and second handle portions 106 are coupled to the support body at an angle less than 100 degrees apart from the slot about a surface of the support body. In some embodiments, the first and second handle portions 106 are coupled to the support body at an angle less than 90 degrees apart from the slot about a surface of the support body.

In some embodiments, the first and second handle portions are coupled to the support body between about 180 degrees and about 150 degrees apart from the slot about a surface of the support body. In some embodiments, the first and second handle portions are coupled to the support body between about 165 degrees and about 125 degrees apart from the slot about a surface of the support body. In some embodiments, the first and second handle portions are coupled to the support body between about 155 degrees and about 135 degrees apart from the slot about a surface of the support body. In some embodiments, the first and second handle portions are coupled to the support body between about 150 degrees and about 140 degrees apart from the slot about a surface of the support body. In some embodiments, the first and second handle portions are coupled to the support body between about 150 degrees and about 90 degrees apart from the slot about a surface of the support body. In some embodiments, the first and second handle portions are coupled to the support body between about 150 degrees and about 120 degrees apart from the slot about a surface of the support body. In some embodiments, the first and second handle portions are coupled to the support body between about 120 degrees and about 90 degrees apart from the slot about a surface of the support body. The angle at which one of the first and second handle portions and the slot are spaced apart from each other about a surface of the support body is shown as angle $\beta$ in FIG. 3B.

As shown in FIGS. 1B, 2B, 3B, and 4B, in some embodiments, the handle portions 106 can be cylindrical or generally cylindrical. In some embodiments, the grip portion 120 can be cylindrical or generally cylindrical. In some embodiments, the handle portions 106 can have a circular or generally circular cross-section. In some embodiments, the grip portions 120 can have a circular of generally circular cross-section. In some embodiments, the grip portions 120 of the system 100B can facilitate gripping by a smaller hand than the grip portions 120 of system 100 shown in FIGS. 1, 2, 3, and 4. In some embodiments, the grip portions 120 of system 100B can be used in the system 100 shown in FIGS. 1, 2, 3, and 4.

FIGS. 5B, 6B, 7B, and 8B, illustrate an embodiment of a bottle support system 200B. In some embodiments, the bottle support system 200B is an alternative embodiment of the bottle support system 200 in which the support body 202 includes a concave or generally concave portion 105 instead of a generally cylindrical portion. In some embodiments, the concave or generally concave portion 105 can extend between the neck portion 204 and the second rim 234 of the support body 202.

In some embodiments, a middle portion 105B of the concave or generally concave portion 105 can have a cross-sectional area smaller than a cross-sectional area of a superior portion 105A of the concave or generally concave portion 105 positioned between the middle portion 105B and the neck portion 204 and smaller than a cross-sectional area of an inferior portion 105C of the concave or generally concave portion 105 positioned between the middle portion 105B and the second end portion.

In some embodiments, a cross-sectional area of the concave or generally concave portion 105 widens from a middle portion 105B of the concave or generally concave portion 105 to the neck portion. In some embodiments, a cross-section area of the concave or generally concave portion 105 widens from the middle portion of the concave or generally concave portion 105 to the second end portion.

In some embodiments, a middle portion 105B of the concave or generally concave portion 105 can have a cross-sectional area smaller than a cross-sectional area at a top end of the concave or generally concave portion 105 and smaller than a cross-sectional area at a bottom end of the concave or generally concave portion 105. In some embodiments, the top end of the concave or generally concave portion 105 is coupled to the neck portion 204. In some embodiments, the bottom end of the concave or generally concave portion 105 defines the second rim 234.

In some embodiments, a middle portion 105B of the concave or generally concave portion 105 can have a cross-sectional area smaller than a cross-sectional area at the first end portion of the support body 202 and smaller than a cross-sectional area at the second end portion of the support body 202. In other embodiments, the cross-sectional area of one or both of the first end portion and the second end portion is smaller than the cross-sectional area of the middle portion 105B.

In some embodiments, a middle portion 105B of the concave or generally concave portion 105 can have a cross-sectional area smaller than a cross-sectional area of the first rim 232 and smaller than a cross-sectional area of the second rim 234. In other embodiments, the cross-sectional area of one or both of the first rim 232 and the second rim 234 is smaller than the cross-sectional area of the middle portion 105B.

In some embodiments, a middle portion 105B of the concave or generally concave portion 105 can have a cross-sectional area smaller than a smallest cross-sectional area of the neck portion 204 and smaller than the cross-sectional area of the second rim 234. In other embodiments, the smallest cross-sectional area of the neck support 204 is smaller than the cross-sectional area of the middle portion 105B.

In some embodiments, a middle portion 105B of the concave or generally concave portion 105 can have a cross-sectional area smaller than a cross-sectional area of the bottom most portion of the neck portion 204 and smaller than the cross-sectional area of the second rim 234.

The concave or generally concave portion 105 of the support body 202 of the bottle support system 200B can facilitate the receipt, gripping, and support of baby bottles having different shapes and/or sizes than the generally cylindrical portion of the support body 202 of the bottle support system 200. For example, in some embodiments, the concave or generally concave portion 105 can receive, grip and support concave bottles. In some embodiments, the concave or generally concave portion 105 of the support body 202 can have a shape that corresponds to the shape of a concave bottle. In other embodiments, the shape of the concave or generally concave portion 105 does not correspond to the shape of the bottle. For example, in some embodiments, the concave or generally concave portion 105 can receive a cylindrical or convex bottle. In some embodiments, the concave or generally concave portion 105 can be sized, shaped, and/or otherwise configured to establish a friction fit with a bottle to secure the bottle within the support body 202. A friction fit can improve manipulation and provided enhanced safety by securely gripping the bottle.

The bottle support system 200B can include any of the same or similar features or functions as the embodiment of the bottle support system 200 described with respect to FIGS. 5, 6, 7, and 8.

As shown in FIGS. 5B, 6B, 7B, and 8B, in some embodiments, the handle portions 206 can be cylindrical or generally cylindrical. In some embodiments, the grip portion 220 can be cylindrical or generally cylindrical. In some embodiments, the handle portions 206 can have a circular or generally circular cross-section. In some embodiments, the grip portions 220 can have a circular of generally circular cross-section. In some embodiments, the grip portions 220 of the system 200B can facilitate gripping by a smaller hand than the grip portions 220 of system 200 shown in FIGS. 5, 6, 7, and 8. In some embodiments, the grip portions 220 of system 200B can be used in the system 200 shown in FIGS. 5, 6, 7, and 8.

Figure 9:
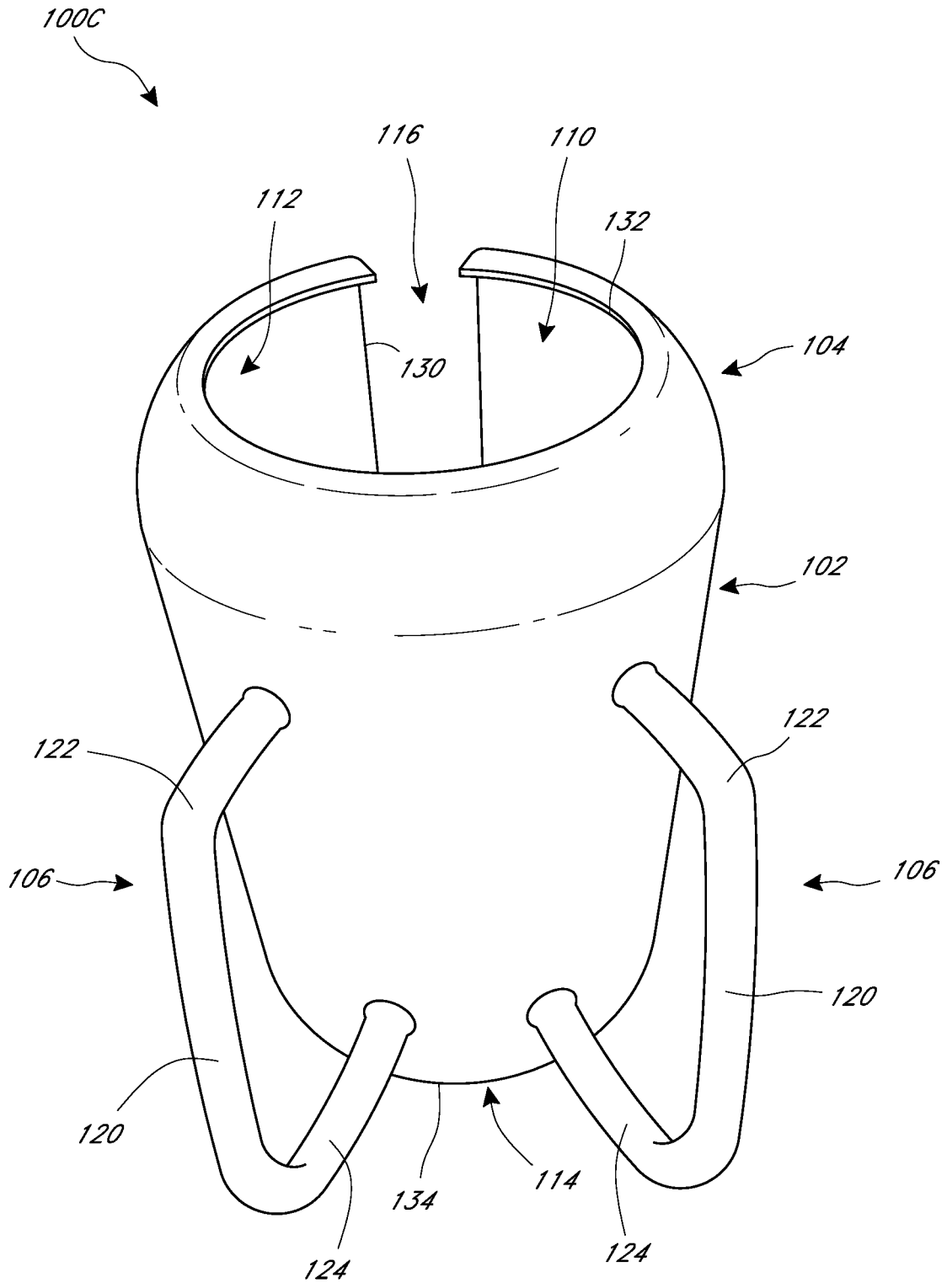
FIG. 9 illustrates a perspective view of one embodiment of a bottle support system.
Figure 10:
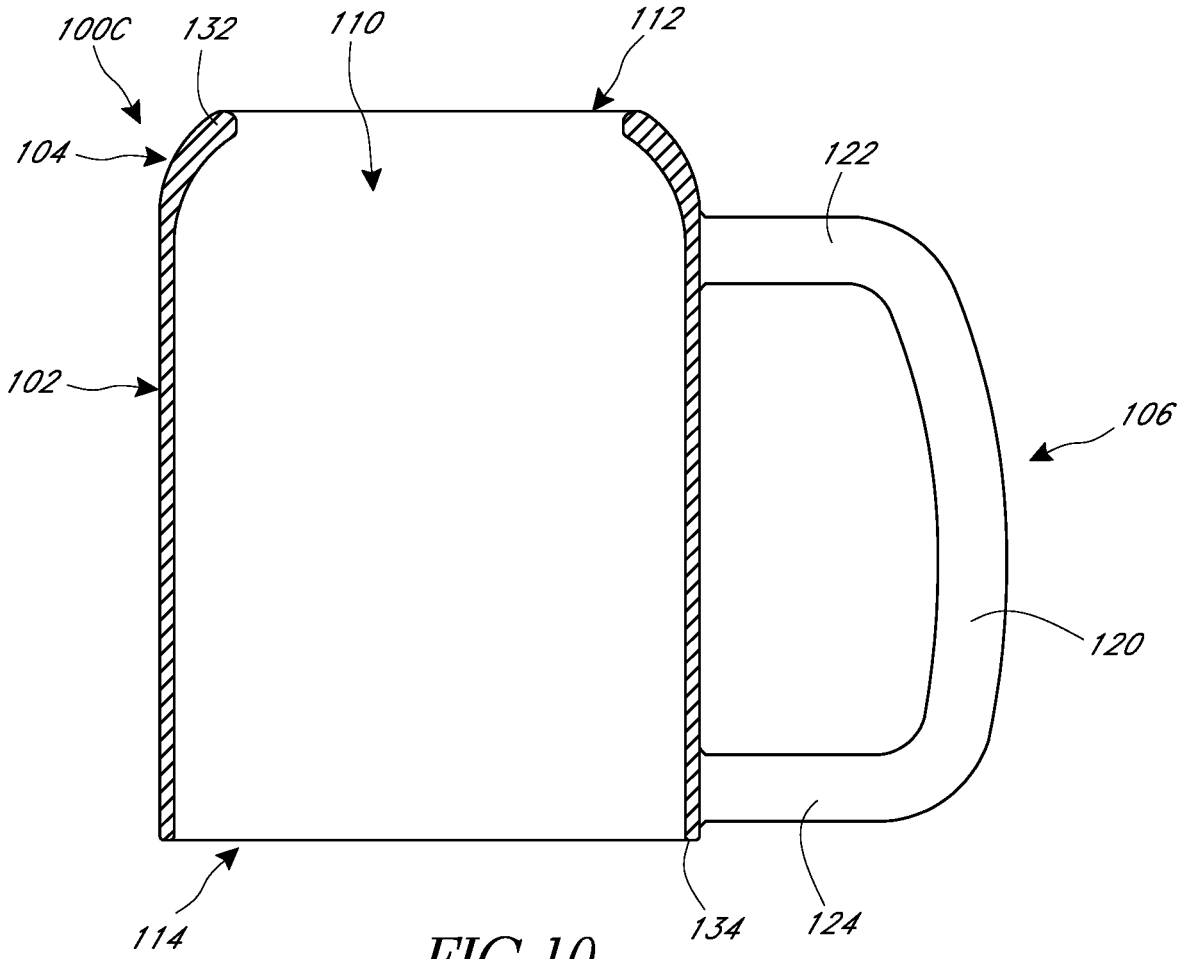
FIG. 10 illustrates a cross-sectional view of the bottle support system of FIG. 9.

FIGS. 9 and 10 illustrate a bottle support system 100C. In some embodiments, the bottle support system 100C is an alternative embodiment of the bottle support system 100, in which the handle portions 106 have a generally different shape. In some embodiments, the handle portions 106 can be cylindrical or generally cylindrical. In some embodiments, the grip portion 120 can be cylindrical or generally cylindrical. In some embodiments, the handle portions 106 can have a circular or generally circular cross-section. In some embodiments, the grip portions 120 can have a circular of generally circular cross-section. In some embodiments, the grip portions 120 of the system 100C can facilitate gripping by a smaller hand than the grip portions 120 of system 100 shown in FIGS. 1, 2, 3, and 4.

The bottle support system 100C can include any of the same or similar features or functions as the embodiment of the bottle support system 100 described with respect to FIGS. 1, 2, 3, and 4.

Figure 11:
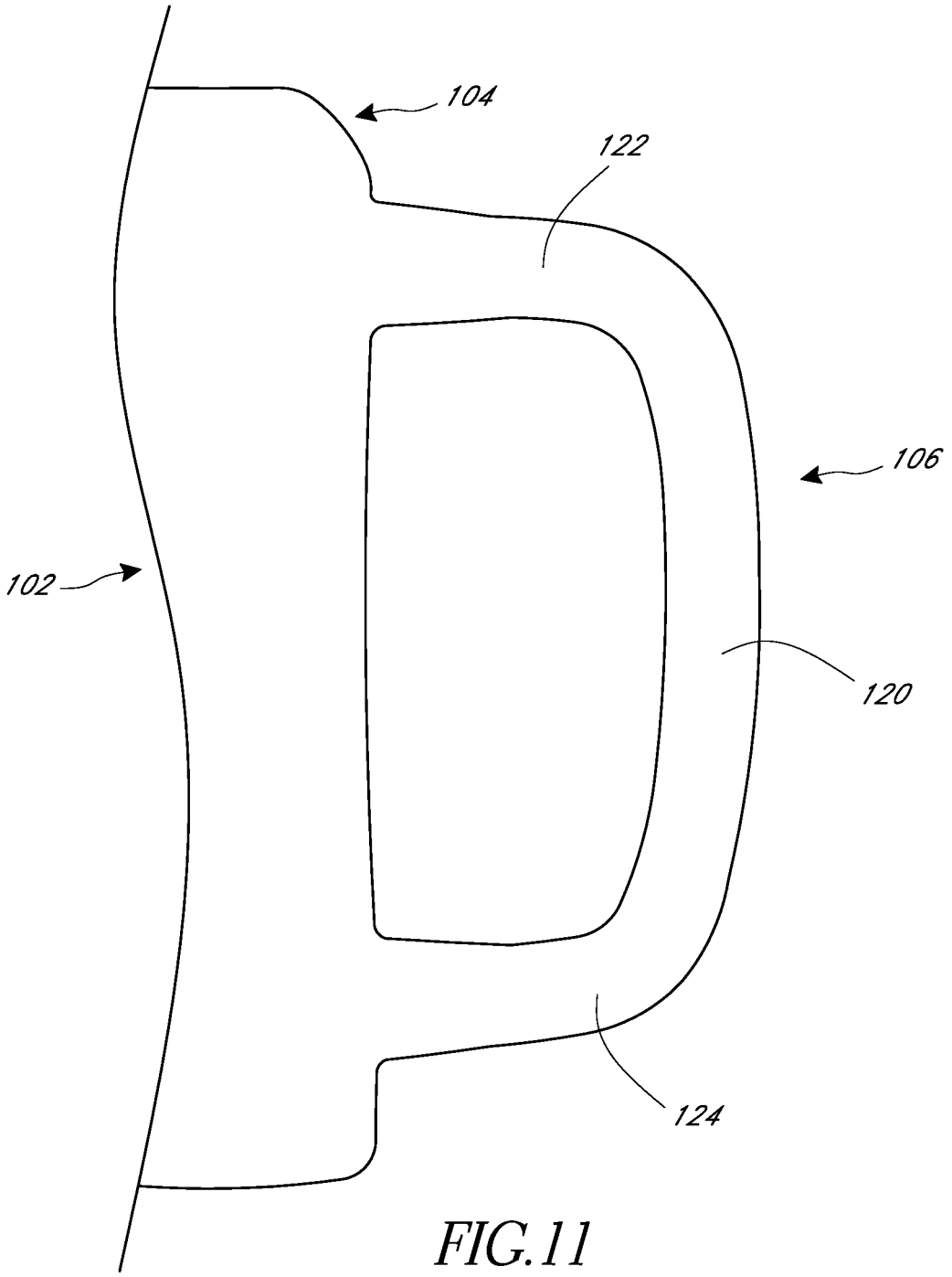
FIG. 11 illustrates a partial view of an embodiment of a support body and handle portion of a bottle support system.

FIG. 11 depicts a partial view of an embodiment of a support body 120 and handle portion 106. As shown in FIG. 11, the handle portion the can be cylindrical or generally cylindrical. In some embodiments, the grip portion 120 can be cylindrical or generally cylindrical. In some embodiments, the handle portions 106 can have a circular or generally circular cross-section. In some embodiments, the grip portions 120 can have a circular of generally circular cross-section. In some embodiments, the grip portions 120 of the system 100A can facilitate gripping by a smaller hand than the grip portions 120 of system 100 shown in FIGS. 1, 2, 3, and 4.

In some embodiments, the handle attachment portions 122 and 124 can be flared or tapered where the handle attachment portions 122 and 124 couple to the support body. For example, in some embodiments, the handle attachment portions 122 and 124 have a larger cross-section at the section at which the handle attachment portions 122 and 124 couple to the support body than at a section closer to the grip portion 120. In some embodiments, the handle attachment portions 122 and 124 can widen between the grip portion 120 and the attachment portions 122 and 124. In some embodiments, the handle attachment portions 122 and 124 can narrow from section at which the handle attachment portions 122 and 124 couple to the support body towards the handle grip portion 120. In some embodiments, the flared design can provide additional strength supporting the connection between the handle portion 106 and the support body 120. In some embodiments, the flared design can provide support strength for the connection between the handle portion 106 and the support body 120 while allowing for a thinner grip portion 120 than in a handle portion design having a uniform cross-section.

The handle portion 106 described with respect to FIG. 11 can be used as a handle portion in any of the embodiments described herein, including in systems 100, 100A, 100B, 100C, 200, 200A, and 200B.

Various modifications to the implementations described in this disclosure may be readily apparent to those skilled in the art, and the principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The terms "generally" and "substantially" mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A support system for a baby bottle comprising:

a support body extending between a first end and a second end, the support body comprising:

a first rim at the first end, the first rim defining a first opening;

a second rim at a second end, the second rim defining a second opening;

a channel extending between the first opening and the second opening, the channel configured to receive at least a portion of a baby bottle a slot extending between the first end and the second end;

a neck portion configured to be positioned about a bottle neck of the baby bottle; and a generally convex portion extending between the neck portion and the second end, the generally convex portion comprising:

a middle portion having a first cross-sectional area;

a superior portion positioned between the middle portion and the first end, the superior portion having a second cross-sectional area; and an inferior portion positioned between the middle portion and the second end, the inferior portion defining a third cross-sectional area, wherein the first cross-sectional area is greater than the second cross-sectional area and the third cross-sectional area; and a pair of handle portions coupled to the support body, each handle portion comprising a handle grip portion and a handle attachment portion.

2. The system of claim 1, wherein a cross-sectional area of the generally convex portion narrows from the middle portion to the neck portion.

3. The system of claim 1, wherein a cross-sectional area of the generally convex portion narrows from the middle portion to the second end.

4. The system of claim 1, wherein a cross-sectional area of the neck portion narrows from the generally convex portion to the first end.

5. The system of claim 1, wherein a cross-sectional area of the second opening is greater than a cross-sectional area of the first opening.

6. The system of claim 1, further comprising the baby bottle positioned within the channel.

7. The system of claim 1, wherein the support body is configured to releasably grip and support the baby bottle positioned within the channel.

8. The system of claim 1, wherein the slot is defined by slot edges in the support body extending from the first rim to the second rim.

9. The system of claim 1, wherein the pair of handles are coupled to the support body at an angle less than 180 degrees apart from each other about a surface of the support body.

10. The system of claim 1, wherein each handle of the pair of handles is coupled to the support body at an angle less than 180 degrees apart from the slot about a surface of the support body.

11. A support system for a baby bottle comprising:

a support body extending between a first end and a second end, the support body comprising:

a first rim at the first end, the first rim defining a first opening;

a second rim at a second end, the second rim defining a second opening;

a channel extending between the first opening and the second opening, the channel configured to receive at least a portion of a baby bottle a slot extending between the first end and the second end;

a neck portion configured to be positioned about a bottle neck of the baby bottle; and a generally concave portion extending between the neck portion and the second end, the generally concave portion comprising:

a middle portion having a first cross-sectional area;

a superior portion positioned between the middle portion and the first end, the superior portion having a second cross-sectional area; and an inferior portion positioned between the middle portion and the second end, the inferior portion defining a third cross-sectional area, wherein the first cross-sectional area is smaller than the second cross-sectional area and the third cross-sectional area; and a pair of handle portions coupled to the support body, each handle portion comprising a handle grip portion and a handle attachment portion.

12. The system of claim 11, wherein a cross-sectional area of the generally concave portion widens from the middle portion to the neck portion.

13. The system of claim 11, wherein a cross-sectional area of the generally concave portion widens from the middle portion to the second end.

14. The system of claim 11, wherein a cross-sectional area of the neck portion narrows from the generally concave portion to the first end.

15. The system of claim 11, wherein a cross-sectional area of the second opening is greater than a cross-sectional area of the first opening.

16. The system of claim 11, wherein the slot is defined by slot edges in the support body extending from the first rim to the second rim.

17. The system of claim 11, further comprising the baby bottle positioned within the channel.

18. The system of claim 11, wherein the support body is configured to releasably grip and support the baby bottle positioned within the channel.

19. The system of claim 11, wherein the pair of handles are coupled to the support body at an angle less than 180 degrees apart from each other about a surface of the support body.

20. The system of claim 11, wherein each handle of the pair of handles is coupled to the support body at an angle less than 180 degrees apart from the slot about a surface of the support body.

* * * * *